US011359299B2

(12) United States Patent
Peng et al.

(10) Patent No.: US 11,359,299 B2
(45) Date of Patent: Jun. 14, 2022

(54) MANUFACTURING METHOD OF INDIUM TIN OXIDE

(71) Applicant: Ming Chi University of Technology, New Taipei (TW)

(72) Inventors: Kun-Cheng Peng, New Taipei (TW); Chi-Ting Chung, New Taipei (TW); Chun-Ying Lee, New Taipei (TW); Ruei-You Liou, New Taipei (TW); Yi-Xian Li, New Taipei (TW)

(73) Assignee: Ming Chi University of Technology, New Taipei (TW)

( * ) Notice: Subject to any disclaimer, the term of this patent is extended or adjusted under 35 U.S.C. 154(b) by 0 days.

(21) Appl. No.: 17/477,548

(22) Filed: Sep. 17, 2021

(65) Prior Publication Data

US 2022/0090285 A1 Mar. 24, 2022

(30) Foreign Application Priority Data

Sep. 22, 2020 (TW) ..... 109132789

(51) Int. Cl.

| | |
|---|---|
| ***C25D 3/66*** | (2006.01) |
| ***C25D 5/50*** | (2006.01) |
| ***C25D 5/10*** | (2006.01) |
| ***C25D 3/54*** | (2006.01) |
| ***C25D 3/32*** | (2006.01) |

(52) U.S. Cl.

CPC ..... *C25D 5/505* (2013.01); *C25D 3/32* (2013.01); *C25D 3/54* (2013.01); *C25D 5/10* (2013.01)

(58) Field of Classification Search

CPC ..... C25D 3/665
USPC ..... 205/225, 230
See application file for complete search history.

(56) References Cited

PUBLICATIONS

Anicai et al., "Electrodeposition of Sn-In Alloys Involving Deep Eutectic Solvents," Coatings (Dec. 2019), vol. 9, No. 12, 800, pp. 1-14. (Year: 2019).*

* cited by examiner

*Primary Examiner* — Edna Wong

(57) ABSTRACT

The present disclosure provides a manufacturing method of indium tin oxide, including: providing a first electrolyte including choline chloride, urea, indium chloride, boric acid, and ascorbic acid; disposing a workpiece, wherein at least a part of the workpiece is in contact with the first electrolyte; heating the first electrolyte to 60° C.-95° C.; applying a first operating current to electroplate indium onto the workpiece; providing an second electrolyte including choline chloride, urea, tin chloride, boric acid, and ascorbic acid; disposing the indium-coated workpiece, wherein at least a part of the workpiece is in contact with the second electroplate; heating the second electroplate to 60° C.-95° C.; applying a second operating current to electroplate tin onto the workpiece; and annealing the indium and tin on the workpiece to form indium tin oxide in an oxygen environment.

10 Claims, 24 Drawing Sheets

MANUFACTURING METHOD OF INDIUM TIN OXIDE

CROSS REFERENCE TO RELATED DISCLOSURE

This application claims the priority benefit of Taiwan Patent Application Number TW109132789, filed on Sep. 22, 2020, the full disclosure of which is incorporated herein by reference.

BACKGROUND

Technical Field

This disclosure is related to an electroplating technique, and in particular, a manufacturing method of indium tin oxide.

Related Art

Indium tin oxide (ITO) is a mixture of indium oxide ($In_2O_3$) and tin oxide ($SnO_2$). In general, the mass ratio of indium oxide and tin oxide in indium tin oxide is about 9:1. In other words, indium oxide is the main ingredient in ordinary indium tine oxide. In addition, the indium tin oxide has excellent electrical conductivity and is transparent in the visible lights.

As mentioned above, as a good electrical conductor and transparent in nature, indium tin oxide is widely used in various digital display. For example, indium tin oxide is widely used for liquid crystal display, plasma display, touch screen, and electronic book, etc. Moreover, indium tin oxide is able to be applied in the optical coating, such as anti-reflection coating.

Recently, for manufacturing indium tin oxide coating, the physical vapor deposition (PVD) or chemical vapor deposition (CVD) is generally used to form indium tin oxide coating on a substrate or a workpiece. However, CVD has a lot of process limitations and is difficult to correspond to the workpiece with complicated shapes. Therefore, CVD is not conducive to large-scale production. In addition, due to the CVD equipment is expensive and the deposition rate of CVD is low, the cost of ITO remains high.

SUMMARY

The embodiments of the present disclosure disclose a manufacturing method of indium tin oxide, in order to solve the problem of the high cost due to the complex process when the indium tin oxide coatings are manufactured by chemical vapor deposition.

In order to solve the aforementioned technical problems, the disclosure provides the following process:

A manufacturing method of indium tin oxide, which includes: providing a first electrolyte including choline chloride, urea, indium chloride, boric acid, and ascorbic acid; disposing a workpiece, wherein at least a part of the workpiece is in contact with the first electrolyte; heating the first electrolyte to 60° C.-95° C.; applying a first operating current to electroplate indium onto the workpiece; providing a second electrolyte including choline chloride, urea, tin chloride, boric acid, and ascorbic acid; disposing the indium-coated workpiece, wherein at least a part of the workpiece is in contact with the second electroplate; heating the second electroplate to 60° C.-95° C.; applying a second operating current to electroplate tin onto the workpiece; and annealing the indium and tin on the workpiece to form indium tin oxide in an oxygen environment.

In the embodiment of the present disclosure, the indium is electroplated on the workpiece by the first electrolyte with specific compositions, and the tin is electroplated on the workpiece by the second electrolyte with specific compositions. Finally, the workpiece electroplated with indium and tin is annealed in an oxygen environment to obtain an indium tin oxide coating. The process of the present disclosure is simple and may be applied to large-area production. Moreover, the composition of the first electrolyte and the second electrolyte used in the electroplating process is safe and non-toxic, and the electrolyte may be reused to reduce the waste of resources.

BRIEF DESCRIPTION OF THE DRAWINGS

The figures described herein are used to provide a further understanding of the present disclosure and constitute a part of the present disclosure. The exemplary embodiments and descriptions of the present disclosure are used to illustrate the present disclosure and do not limit the present disclosure, in which.

DETAILED DESCRIPTION OF THE EMBODIMENTS

Figure 1:
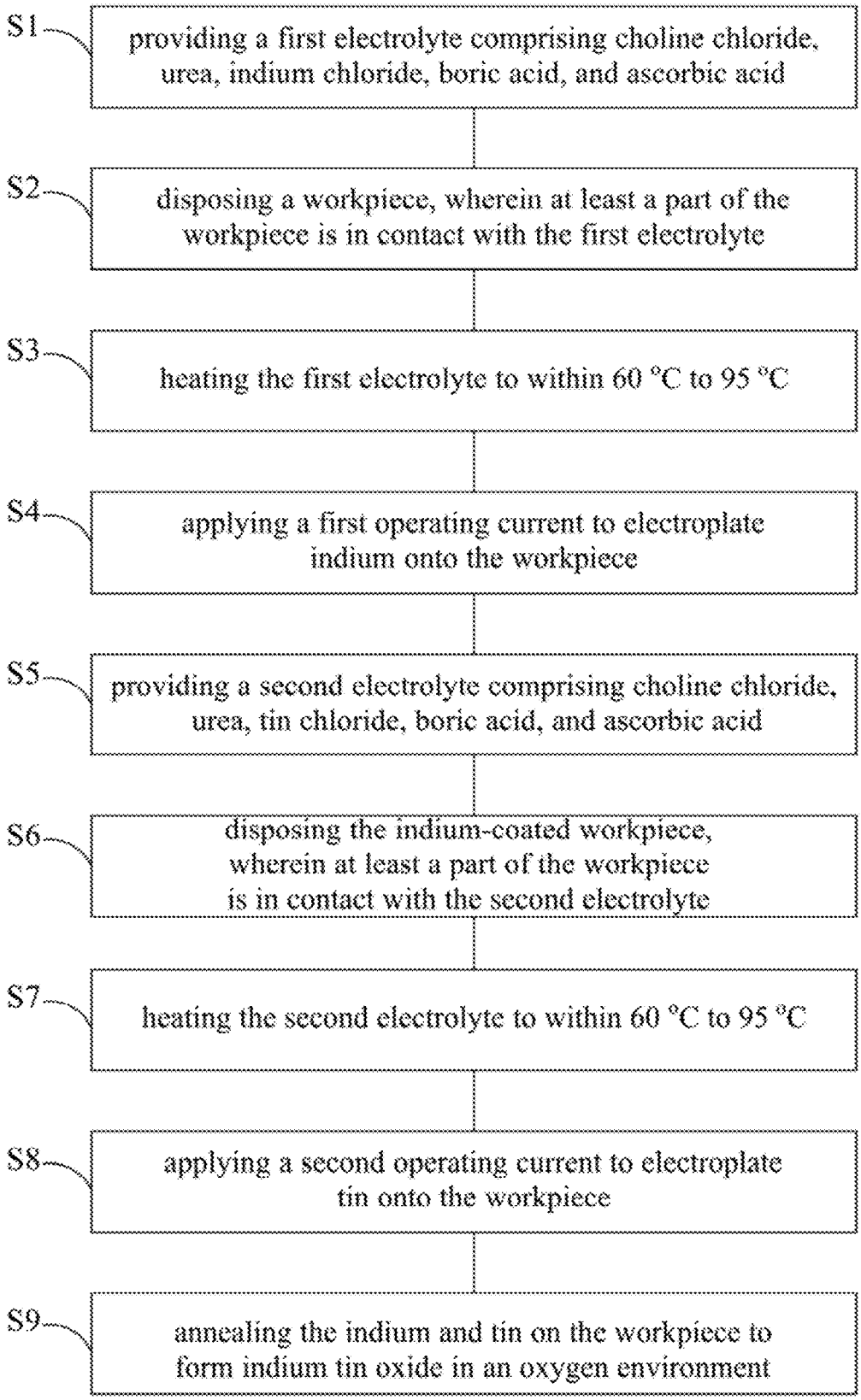
FIG. 1 is the flowchart of the manufacturing method of indium tin oxide according to an embodiment of the present disclosure.
Figure 2:
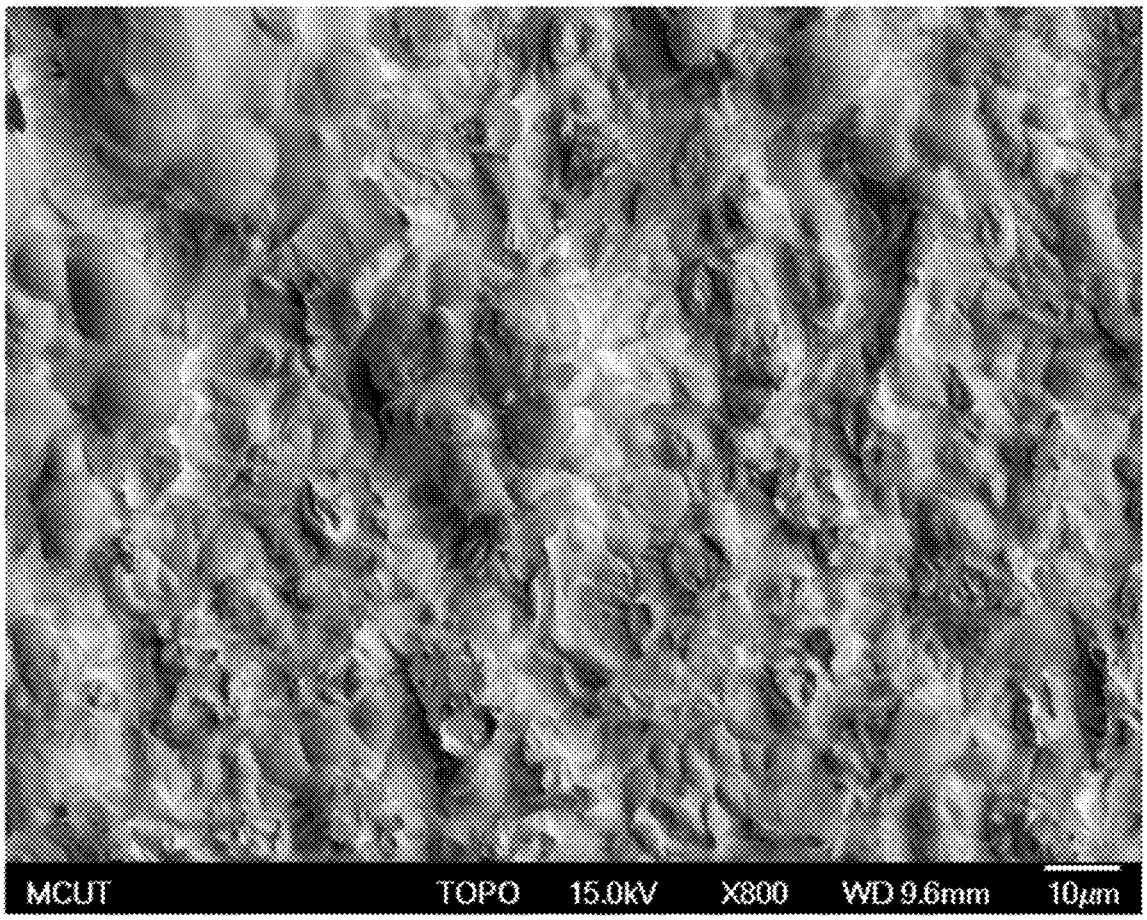
FIG. 2 to FIG. 6 respectively are the surface morphologies of the ITO according to the first embodiment of the present disclosure.
Figure 3:
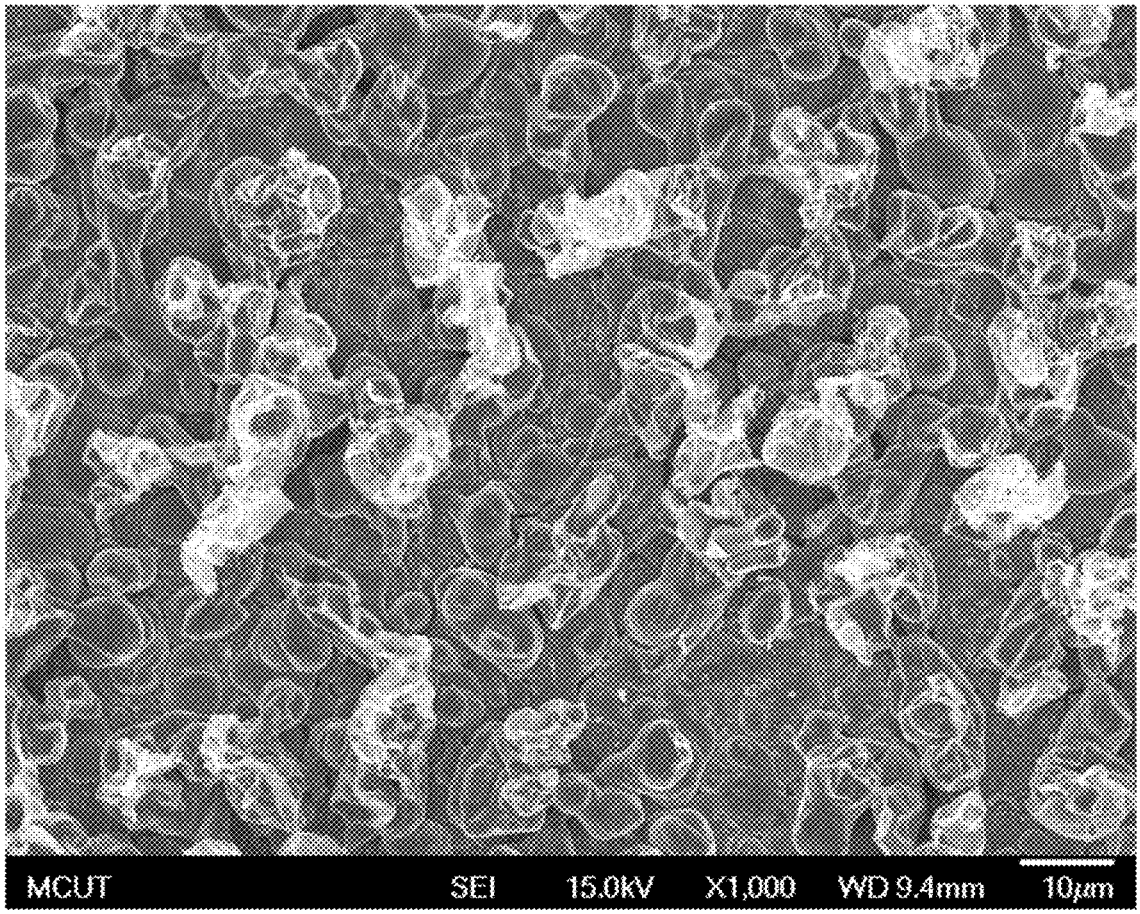
Figure 4:
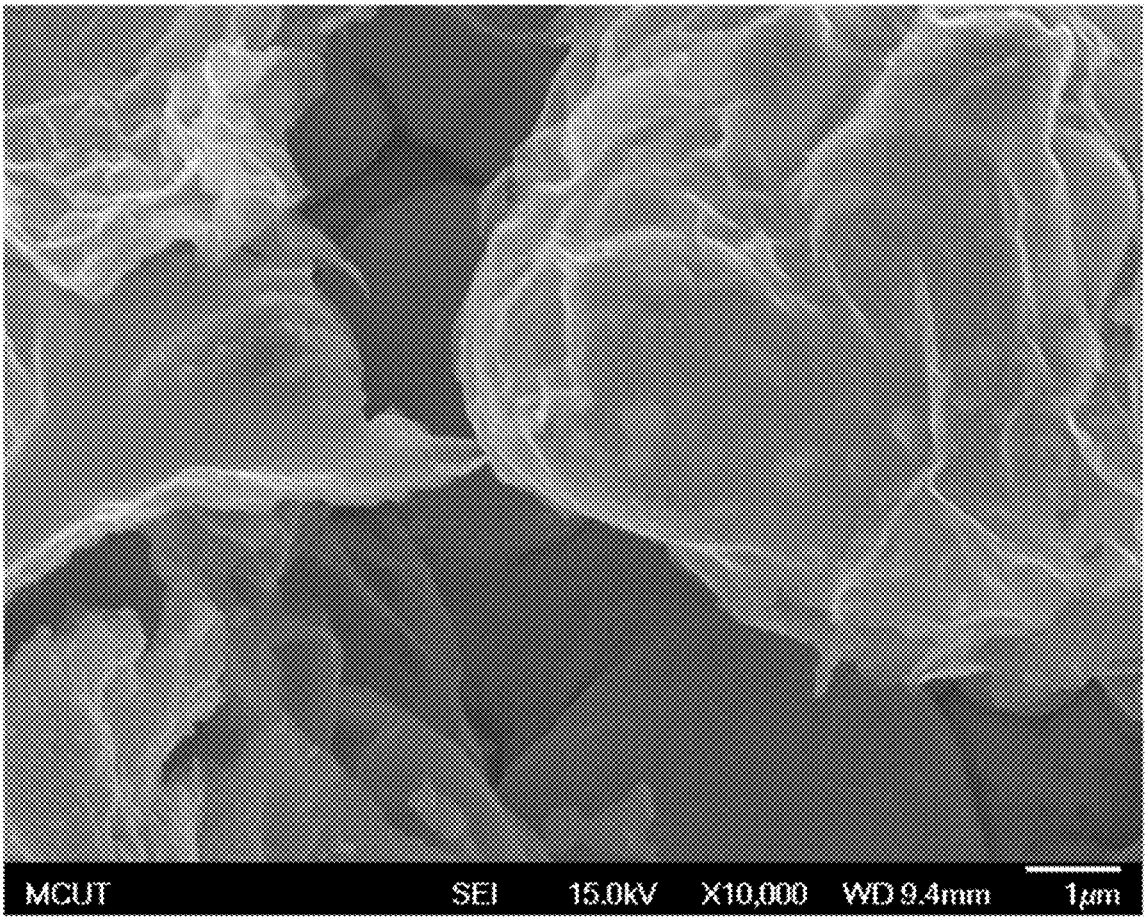
Figure 5:
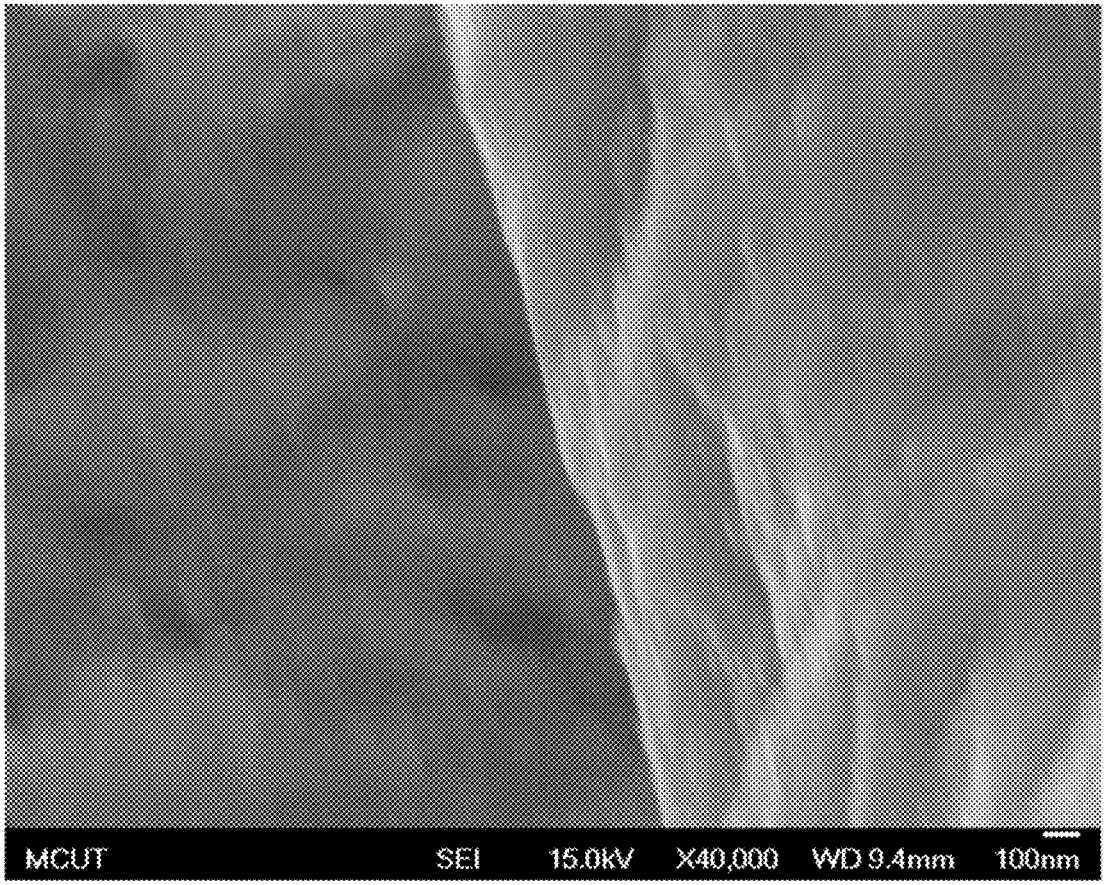

In order to make the objectives, technical solutions, and advantages of the present disclosure clearer, the technical solutions of the present disclosure will be described clearly and completely in conjunction with specific embodiments and the figures of the present disclosure. Obviously, the described embodiments are only a part of the embodiments of the present disclosure, rather than all the embodiments. Based on the embodiments in the present disclosure, all other embodiments obtained by a person of ordinary skill in the art without creative work fall within the protection scope of this disclosure.

The following description is of the best-contemplated mode of carrying out the present disclosure. This description is made for the purpose of illustrating the general principles of the present disclosure and should not be taken in a limiting sense. The scope of the present disclosure is best determined by reference to the appended claims.

Moreover, the terms "include", "contain", and any variation thereof are intended to cover a non-exclusive inclusion. Therefore, a process, method, object, or device that comprises a series of elements not only includes these elements, but also comprises other elements not specified expressly, or may include inherent elements of the process, method, object, or device. If no more limitations are made, an element limited by "include a/an . . . " does not exclude other same elements existing in the process, the method, the article, or the device which comprises the element.

The manufacturing method of ITO of the present disclosure includes a plurality of steps and is applied to any electroplating and annealing equipment recognized by a person of ordinary skill in the art. More specifically, the electroplating equipment in the present disclosure includes the first electroplating equipment and the second electroplating equipment. The first electroplating equipment is employed in the electroplating of indium while the second one is in the electroplating of tin.

In some embodiments, the first electroplating equipment may include a first electroplating tank, a first target, and a first power supply. The first power supply includes the anode and cathode. The first target is electrically connected to the anode of the first power supply. The first target includes indium metal or alloy to be the source of indium ions. In some embodiments, the first electroplating equipment may further include a first absorbent component. The absorbent component is electrically connected to the first power supply and generates static electricity by the current provided by the power supply to absorb carbon ions generated during the electroplating process.

In some embodiments, the second electroplating equipment may include a second electroplating tank, a second target and, a second power supply. The second electroplating tank and the second power supply are similar to the first electroplating tank and the first power supply, so the descriptions thereof are omitted. In addition, the second target includes tin metal or alloy to be the source of indium ions.

In some embodiments, the annealing equipment may be a rapid thermal annealing (RTA) furnace, which may be applied to anneal the product or workpiece just electroplated with indium and tin to reduce the internal stress generated during the electroplating process of the products or workpieces. Furthermore, the annealing process may make the atomic in the indium coating and tin coating diffusion to form new grains.

FIG. 1 is the flowchart of the manufacturing method of indium tin oxide according to an embodiment of the present disclosure. As shown in the figure:

Step S1: Providing a first electrolyte including choline chloride, urea, indium chloride, boric acid, and ascorbic acid. The first electrolyte is disposed in the first electroplating tank of the first electroplating equipment and at least a part of the first target is submerged in the first electrolyte. In some embodiments, the first absorbent component included in the first electroplating equipment may also be submerged in the first electrolyte.

The purpose of adding choline chloride and urea is to form deep eutectic solvent. More specifically, the mixture of choline chloride and urea with a specific ratio is liquid at room temperature. In some embodiment, the concentration of choline chloride in the first electrolyte is 560 g/L. According to the molar concentration formula (molar concentration=mass of solute (g)/molecular mass of solute (g)/solution volume (L)), the molar concentration of choline chloride is 4 M. The concentration of urea in the first electrolyte is 480 g/L, or the molar concentration thereof is 8 M. In other words, the molar ratio of choline chloride and urea in the first electrolyte is 1:2. The first electrolyte with the present molar ratio has the lowest melting temperature of 12° C. However, the present disclosure is not limited thereto. The concentration of choline chloride in the first electrolyte may be within 460 g/L to 660 g/L and the concentration of urea may be within 380 g/L to 580 g/L. The preferred mixing ratio in the first electrolyte is 560 g of choline chloride and 480 g of urea per litter. In some embodiments, 560 g of choline chloride and 480 g of urea are mixed and heated to 80° C. to form the ionic liquid. The ionic liquid is the main ingredient of the first electrolyte of the present disclosure.

The purpose of adding indium chloride is to provide the source of indium ions in the first electrolyte. In some embodiments, the molar concentration of indium chloride may be within 0.005 M to 1 M. For example, the concentration of indium chloride ($InCl_3$) added to the first electrolyte is 150 g/L or 0.5 M. However, the present disclosure is not limited thereto. The concentration of indium chloride in the first electrolyte may be within 120 g/L to 180 g/L, and the preferred adding amount is 150 g/L.

The purpose of adding ascorbic acid is to eliminate the oxygen bubbles in the first electrolyte, therefore the quality of electroplating is improved. In some embodiments, the molar concentration of ascorbic acid may be within 0.025 M to 0.15 M. For example, the concentration of ascorbic acid in the first electrolyte is 2 g/250 mL or 0.05 M. However, the present disclosure is not limited thereto. The concentration of ascorbic acid in the first electrolyte may be within 1 g/250 mL to 6 g/250 mL, and the preferred adding amount is 2 g/250 mL.

The purpose of adding boric acid is to stabilize the pH value of the first electrolyte, i.e. Adjust the concentration of hydrogen ions. The first electrolyte after adding boric acid becomes weakly acidic and has a pH value of about 4. in some embodiments, the molar concentration of boric acid may be within 0.7 m to 2 m. For example, the concentration of boric acid in the first electrolyte is 20 g/200 ml or 1.62 m. However, the present disclosure is not limited thereto. The concentration of ascorbic acid in the first electrolyte may be within 15 g/200 ml to 25 g/200 ml, and the preferred adding amount is 20 g/200 ml.

In some embodiments, the first electrolyte may further include saccharin ($C_7H_5NO_3S$). The purpose of adding saccharin is to refine the grain size of indium coating, adjust the internal stress, and improve the surface finish of the indium coating. In some embodiments, the molar concentration of saccharin may be within 0.03 M to 0.2 M. For example, the concentration of saccharin in the first electrolyte is 2 g/200 mL or 0.05 M. However, the present disclosure is not limited thereto. The concentration of saccharin in the first electrolyte may be within 2 g/200 mL to 7 g/200 mL, and the preferred adding amount is 2 g/200 mL.

In some embodiment, the first electrolyte may also include glycerol ($C_3H_8O_3$). The adding of glycerol is to form compound lipid with boric acid. The volumetric ratio of boric acid and glycerol may be within 4:1 to 3:1, but the present disclosure is not limited thereto. It should be noted that glycerol does not necessarily involve in the electroplating process. The glycerol is used to dilute the concentration of metal ions.

In some embodiments, the first electrolyte may also include chitin ($(C_8H_{13}O_5N)_n$). The purpose of adding chitin is to alter the surface property of the indium coating.

In some embodiments, the first electrolyte may further include brightener, stabilizer, softener, wetting agent, leveling agent, or any combinations thereof according to different requirements.

In general, the first electrolyte of the present disclosure is ionic liquid and may contain no water. Therefore, the overall liquid temperature does not rise too much after electroplating, thus delaying the degradation rate of the first electrolyte of the present application.

Step S2: Disposing a workpiece, wherein at least a part of the workpiece is in contact with the first electrolyte. The workpiece is electrically conductive or at least partially conductive and is electrically connected to the cathode of the first power supply. In some embodiments, the workpiece may be metal or other material coated with a metallic layer on the surface. For example, the workpiece may include copper or alloys thereof.

In some embodiments, the workpiece may be polished by using emery paper or rinsed by using diluted hydrochloric acid to remove the rust on the surface. Then, the de-rusted workpiece is degreased by rinsing with sodium hydroxide solution. Finally, the workpiece is rinsed with distilled water, disposed in the first electroplating equipment, and electrically connected to the first power supply and in contact with the first electrolyte.

Step S3: Heating the first electrolyte up to 60° C. to 95° C. The first electrolyte is anhydrous ionic liquid, so the first electrolyte has a certain viscosity. The viscosity decreases as the temperature increases. When the temperature is lower than 60° C., the viscosity of the first electrolyte is too high. Therefore, indium ions do not flow easily, and the deposition rate is too low. In contrast, when the temperature is higher than 95° C., the surface structure of the indium coating is damaged and the quality of the coating is reduced. Therefore, the preferred working temperature for the first electrolyte is within 60° C. to 95° C. For example, the working temperature for the first electrolyte may be 60° C. 65° C., 70° C., 75° C., 80° C., 85° C., 90° C., 95° C., or any temperature within the range mentioned above.

Step S4: Applying a first operating current to electroplate indium onto the workpiece. When the power switch is on, the first power supply provides direct current to the workpiece and the first target to perform electroplating. During the electroplating process, the reaction at the anode is $In \rightarrow In^{3+}+3e^-$, while the reaction at the cathode is $In^{3+}+3e^- \rightarrow In$. Specifically, the indium of the first target releases electrons and becomes indium ion ($In^{3+}$) dissolved in the first electrolyte. The $In^{3+}$ in the first electrolyte receives the electrons from the first target and is reduced into indium metal. Then, the indium metal is deposited on the surface of the workpiece at the cathode. In some embodiments, the first operating current may be within the range of 1 mA to 10 mA. For example, the first operating current may be 1 mA, 2 mA, 3 mA, 4 mA, 5 mA, 6 mA, 7 mA, 8 mA, 9 mA, 10 mA, or any current within the range mentioned above.

Step S5: Providing a second electrolyte including choline chloride, urea, indium chloride, boric acid, and ascorbic acid. The second electrolyte is disposed in the second electroplating tank of the second electroplating equipment and at least a part of the second target is submerged in the second electrolyte. In some embodiments, the second absorbent component included in the second electroplating equipment may also be submerged in the second electrolyte. The choline chloride, urea, indium chloride, boric acid, and ascorbic acid in the second electrolyte may have a similar or the same function as the choline chloride, urea, indium chloride, boric acid, and ascorbic acid in the first electrolyte, so the descriptions thereof are omitted.

In some embodiment, the concentration of choline chloride in the second electrolyte is 560 g/L, or the molar concentration of choline chloride is 4 M. The concentration of urea in the second electrolyte is 480 g/L, or the molar concentration thereof is 8 M. However, the present disclosure is not limited thereto. The concentration of choline chloride in the second electrolyte may be within 460 g/L to 660 g/L and the concentration of urea may be within 380 g/L to 580 g/L. The preferred mixing ratio in the second electrolyte is 560 g of choline chloride and 480 g of urea per litter. In some embodiments, 560 g of choline chloride and 480 g of urea are mixed and heated to 80° C. to form the ionic liquid. The ionic liquid is the main ingredient of the second electrolyte of the present disclosure.

The purpose of adding tin chloride is to provide the source of tin ions in the second electrolyte. In some embodiments, the molar concentration of tin chloride may be within 0.005 M to 1 M. For example, the concentration of tin chloride (tin chloride pentahydrate, $SnCl_4.5H_2O$) added to the second electrolyte is 175 g/L or 0.5 M. However, the present disclosure is not limited thereto. The concentration of tin chloride in the second electrolyte may be within 145 g/L to 205 g/L, and the preferred adding amount is 175 g/L.

In some embodiments, the molar concentration of ascorbic acid may be within 0.025 M to 0.15 M. For example, the concentration of ascorbic acid in the second electrolyte is 2 g/250 mL or 0.05 M. However, the present disclosure is not limited thereto. The concentration of ascorbic acid in the second electrolyte may be within 1 g/250 mL to 6 g/250 mL, and the preferred adding amount is 2 g/250 mL.

The purpose of adding boric acid is to stabilize the pH value of the second electrolyte, i.e. adjust the concentration of hydrogen ions. The second electrolyte after adding oric acid becomes weakly acidic and has a pH value of about 4. In some embodiments, the molar concentration of boric acid may be within 0.7 M to 2 M. For example, the concentration of boric acid in the second electrolyte is 20 g/200 mL or 1.62 M. However, the present disclosure is not limited thereto. The concentration of ascorbic acid in the second electrolyte may be within 15 g/200 mL to 25 g/200 mL, and the preferred adding amount is 20 g/200 mL.

In some embodiments, the second electrolyte may further include saccharin. In some embodiments, the molar concentration of saccharin may be within 0.03 M to 0.2 M. For example, the concentration of saccharin in the second electrolyte is 2 g/200 mL or 0.05 M. However, the present disclosure is not limited thereto. The concentration of saccharin in the second electrolyte may be within 2 g/200 mL to 7 g/200 mL, and the preferred adding amount is 2 g/200 mL.

In addition, the second electrolyte may further include brightener, stabilizer, softener, wetting agent, leveling agent, or any combinations thereof, which have similar or the same functions as include brightener, stabilizer, softener, wetting agent, leveling agent in the first electrolyte. Therefore, the descriptions thereof are omitted.

In general, the first electrolyte of the present disclosure is ionic liquid and may contain no water. Therefore, the overall liquid temperature does not rise too much after electroplating, thus delaying the degradation rate of the first electrolyte of the present application.

Step S6: Disposing the indium-coated workpiece, wherein at least a part of the workpiece is in contact with the second electrolyte. More specifically, at least a part of the workpiece in contact with the second electrolyte is a part that has been plated with an indium coating. In other words, the tin to be electroplated in the subsequent steps will be deposited on the indium coating.

Step S7: Heating the second electrolyte up to 60° C. to 95° C. The second electrolyte is anhydrous ionic liquid, so the second electrolyte has a certain viscosity. The viscosity decreases as the temperature increases. When the temperature is lower than 60° C., the viscosity of the second electrolyte is too high. Therefore, tin ions do not flow easily, and the deposition rate is too low. In contrast, when the temperature is higher than 95° C., the surface structure of the tin coating is damaged and the quality of the coating is reduced. Therefore, the preferred working temperature for the second electrolyte is within 60° C. to 95° C. For example, the working temperature for the second electrolyte may be 60° C., 65° C., 70° C., 75° C., 80° C., 85° C., 90° C., 95° C., or any temperature within the range mentioned above.

Step S8: Applying a second operating current to electroplate tin onto the workpiece. When the power switch is on, the second power supply provides direct current to the workpiece and the second target to perform electroplating. During the electroplating process, the reaction at the anode is $Sn \rightarrow Sn^{4+} + 4e^-$, while the reaction at the cathode is $Sn^{4+} + 4e^- \rightarrow Sn$. Specifically, the tin of the second target releases electrons and becomes tin ion ($Sn^{4+}$) dissolved in the second electrolyte. The $Sn^{4+}$ in the second electrolyte receives the electrons from the second target and is reduced into tin metal. Then, the tin metal is deposited on the indium coating of the workpiece at the cathode. In some embodiments, the second operating current may be within the range of 1 mA to 10 mA. For example, the second operating current may be 1 mA, 2 mA, 3 mA, 4 mA, 5 mA, 6 mA, 7 mA, 8 mA, 9 mA, 10 mA, or any current within the range mentioned above.

Step S9: Annealing the indium and tin on the workpiece to form indium tin oxide in an oxygen environment. The annealing belongs to a thermal activation process. When the annealing temperature is lower than 150° C., the effect of the stress relief is limited and the crystallization of ITO is formed difficult. In contrast, when the annealing temperature is higher than 400° C., the grains of the crystallization are too coarse. The quality of the coating is worse, and the coating may even crack due to thermal stress. Therefore, the preferred annealing temperature range is within 150° C. to 400° C. For example, the annealing temperature may be 150° C., 200° C., 250° C., 300° C., 350° C., 400° C., or any temperature within the range mentioned above.

In some embodiments, the annealing equipment may have the capability of providing a controlled oxygen environment during annealing. More specifically, the volumetric flow rate of oxygen is within 10 sccm to 30 sccm. For example, the flow rate may be 10 sccm, 15 sccm, 20 sccm, 25 sccm, 30 sccm, or any flow rate within the range mentioned above.

Hereinafter, the indium tin oxide manufactured according to the method of the present application will be discussed. Wherein, the parameters of the first embodiment to the third embodiment are shown in Table 1:

TABLE 1

| Item | Parameters | 1st embodiment | 2nd embodiment | 3rd embodiment |
|---|---|---|---|---|
| 1st electrolyte | Choline chloride | 139.63 g/250 mL | 139.63 g/250 mL | 139.63 g/250 mL |
| | Urea | 120.12 g/250 mL | 120.12 g/250 mL | 120.12 g/250 mL |
| | Indium chloride | 0.19M | 0.19M | 0.19M |
| | Boric acid | 0.65M | 0.65M | 0.65M |
| | Ascorbic acid | 0.23M | 0.23M | 0.23M |
| | Temperature | 75° C. to 95° C. | 75° C to 95° C. | 75° C. to 95° C. |
| | Electrical current | 0.01 A | 0.01 A | 0.01 A |
| | Voltage | 0.5 V to 1.5 V | 0.5 V to 1.5 V | 0.5 V to 1.5 V |
| | Plating duration | 120 min | 120 min | 120 min |
| | Coating thickness | 1.174 um | 1.224 um | 1.265 um |
| 2nd electrolyte | Choline chloride | 139.63 g/250 mL | 139.63 g/250 mL | 139.63 g/250 mL |
| | Urea | 120.12 g/250 mL | 120.12 g/250 mL | 120.12 g/250 mL |
| | Indium chloride | 0.19M | 0.19M | 0.19M |
| | Boric acid | 0.65M | 0.65M | 0.65M |
| | Ascorbic acid | 0.23M | 0.23M | 0.23M |
| | Temperature | 75° C. to 95° C. | 75° C. to 95° C. | 75° C. to 95° C. |
| | Electrical current | 0.01 A | 0.01 A | 0.01 A |
| | Voltage | 0.5 V to 1.5 V | 0.5 V to 1.5 V | 0.5 V to 1.5 V |
| | Plating duration | 120 min | 120 min | 120 min |
| | Coating thickness | 1.211 um | 1.231 um | 1.273 um |
| Annealing | Temperature | 200° C. | 250° C. | 350° C. |
| | Duration | 60 min | 30 min | 15 min |
| | Oxygen flow rate | 2 sccm | 35 sccm | 35 sccm |

FIG. 2 to FIG. 5 respectively are the surface morphologies of the ITO according to the first embodiment of the present disclosure. More specifically, these figures are at different magnifications, respectively: 800× for FIG. 2, 1 k× for FIG. 3, 10 k× for FIG. 4, and 40 k× for FIG. 5. As shown in the figure, the surface morphology of the indium tin oxide of the first embodiment is round particles. In addition, the sizes of the grains are within about 10 um-20 um.

Figure 6:
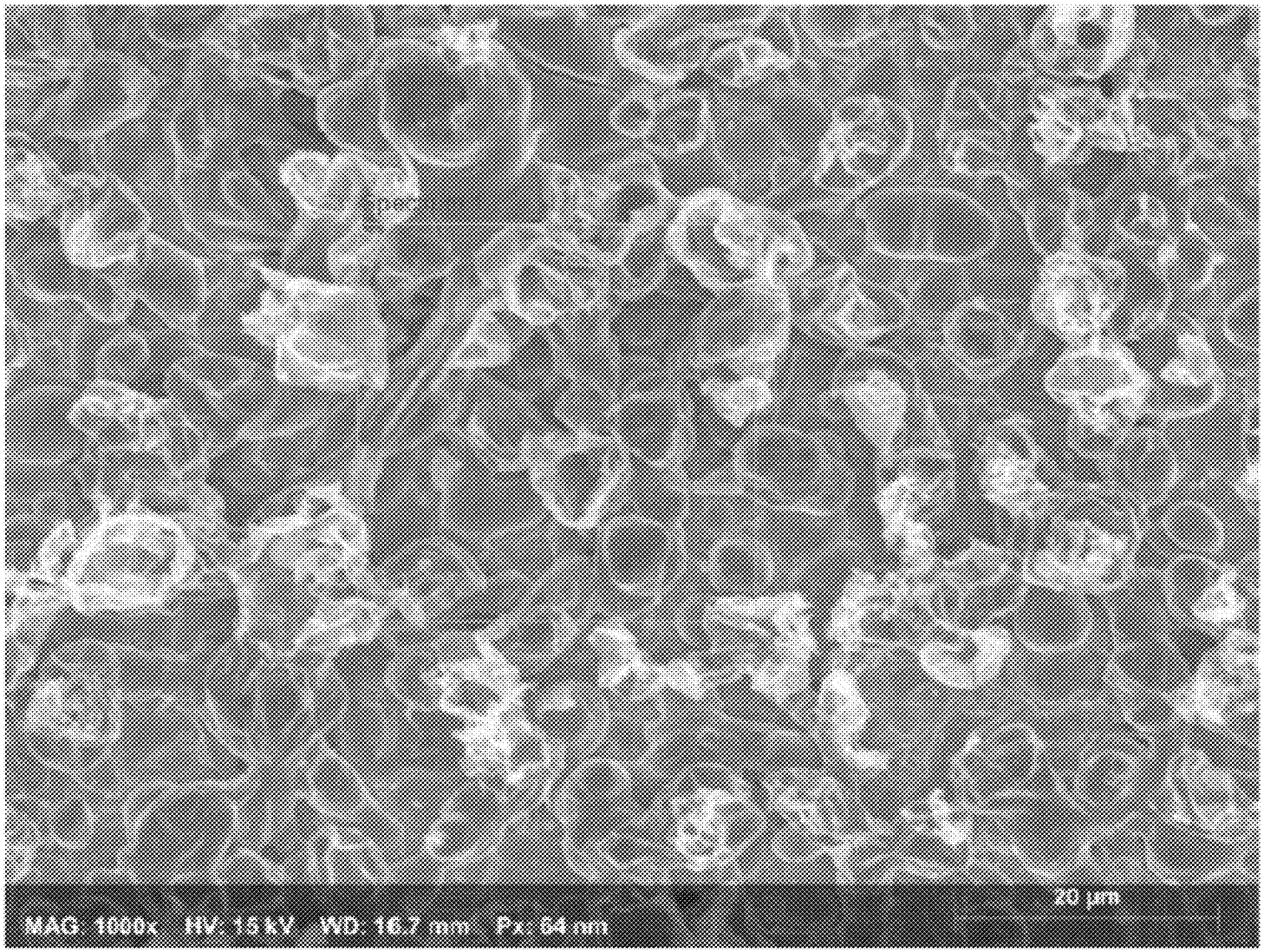
Figure 7:
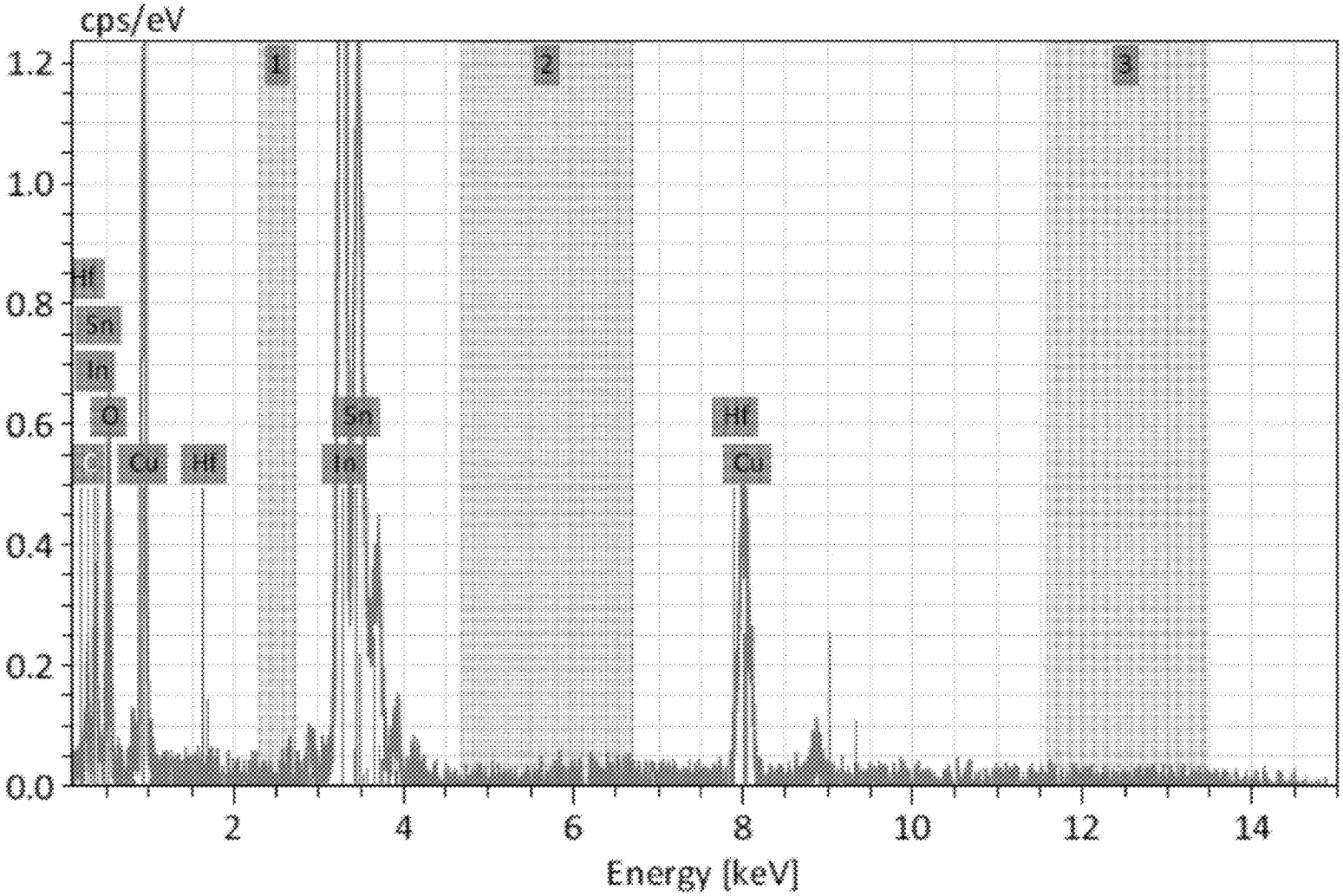
FIG. 7 is the element analysis diagram of the ITO according to the first embodiment of the present disclosure.

FIG. 6 and FIG. 7 respectively are the surface morphology and element analysis diagram of the indium tin oxide coating manufacturing according to the first embodiment of the present disclosure. Specifically, FIG. 7 presents the measured compositions from a certain region in FIG. 6. Further, the composition of the components in FIG. 7 is converted into weight percentage and atomic percentage as shown in Table 2. As shown in the figure, that the coating includes indium and tin may be confirmed from the composition weight percent (wt. %) or atom percentage (at. %).

TABLE 2

| Element | Atomic number | Spectrum | Compositions wt. % | Compositions at. % |
|---|---|---|---|---|
| Carbon | 6 | K series | 1.93 | 9.43 |
| Oxygen | 8 | K series | 9.18 | 33.75 |
| Copper | 29 | K series | 28.42 | 26.32 |
| Indium | 49 | L series | 31.23 | 16.01 |
| Tin | 50 | L series | 29.24 | 14.49 |

Figure 8:
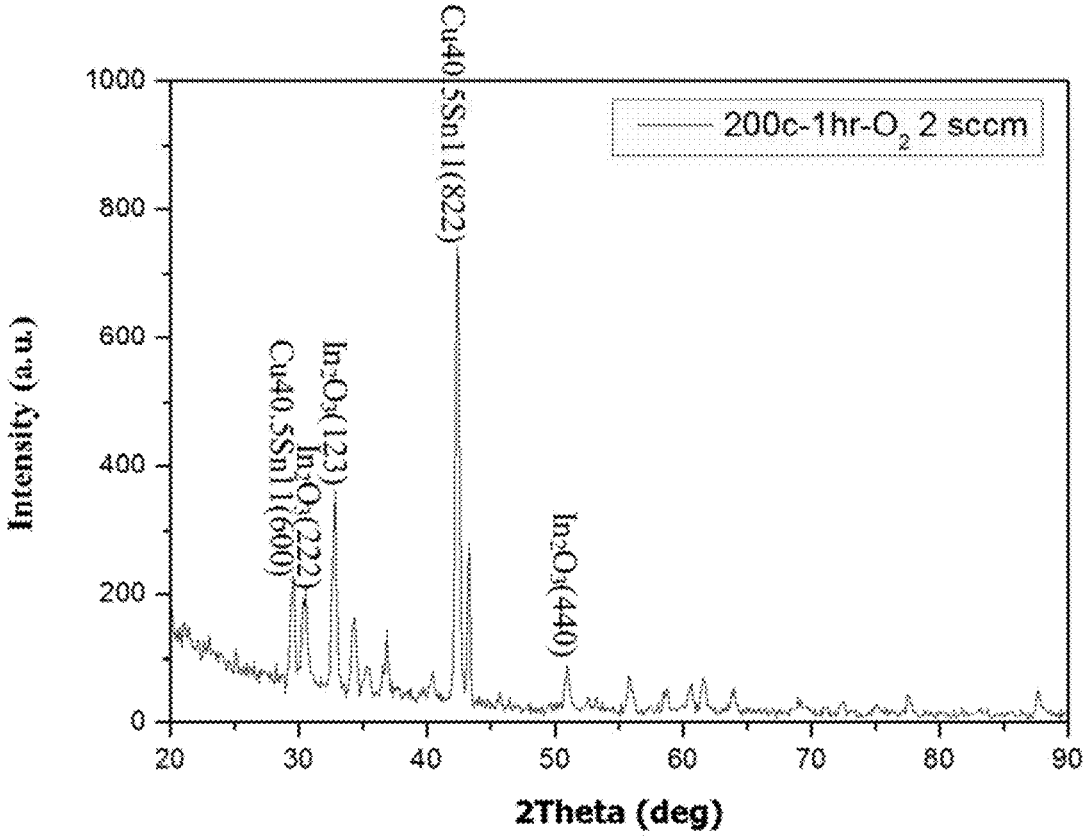
FIG. 8 is the X-ray diffraction spectrum of the ITO according to the first embodiment of the present disclosure.
Figure 9:
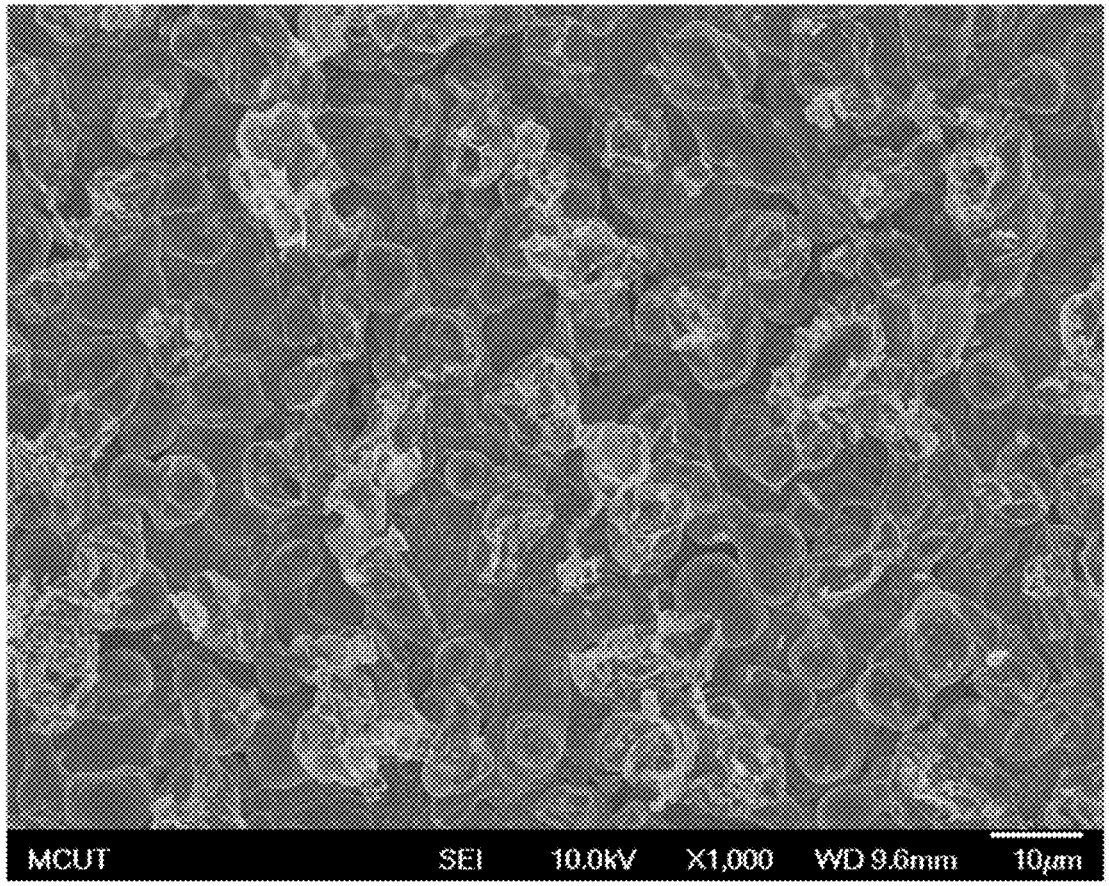
FIG. 9 to FIG. 14 respectively are the surface morphologies of the ITO according to the second embodiment of the present disclosure.
Figure 10:
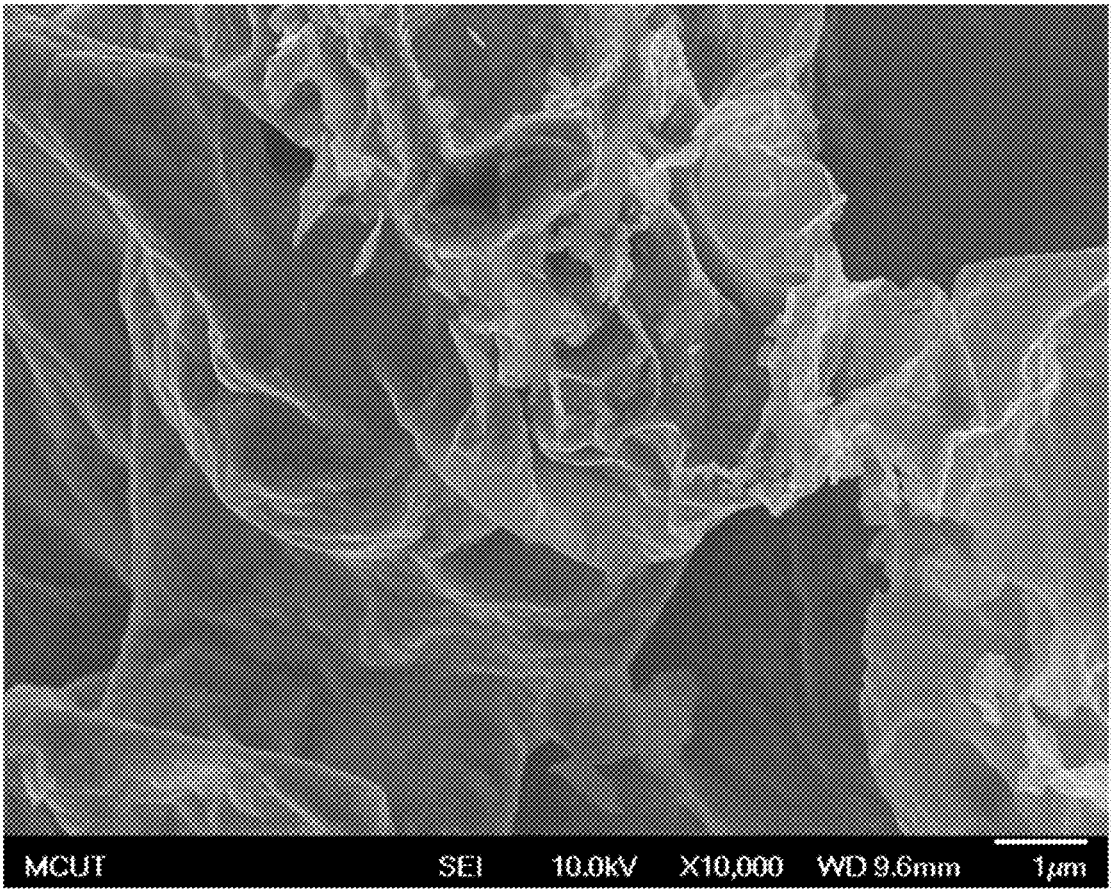
Figure 11:
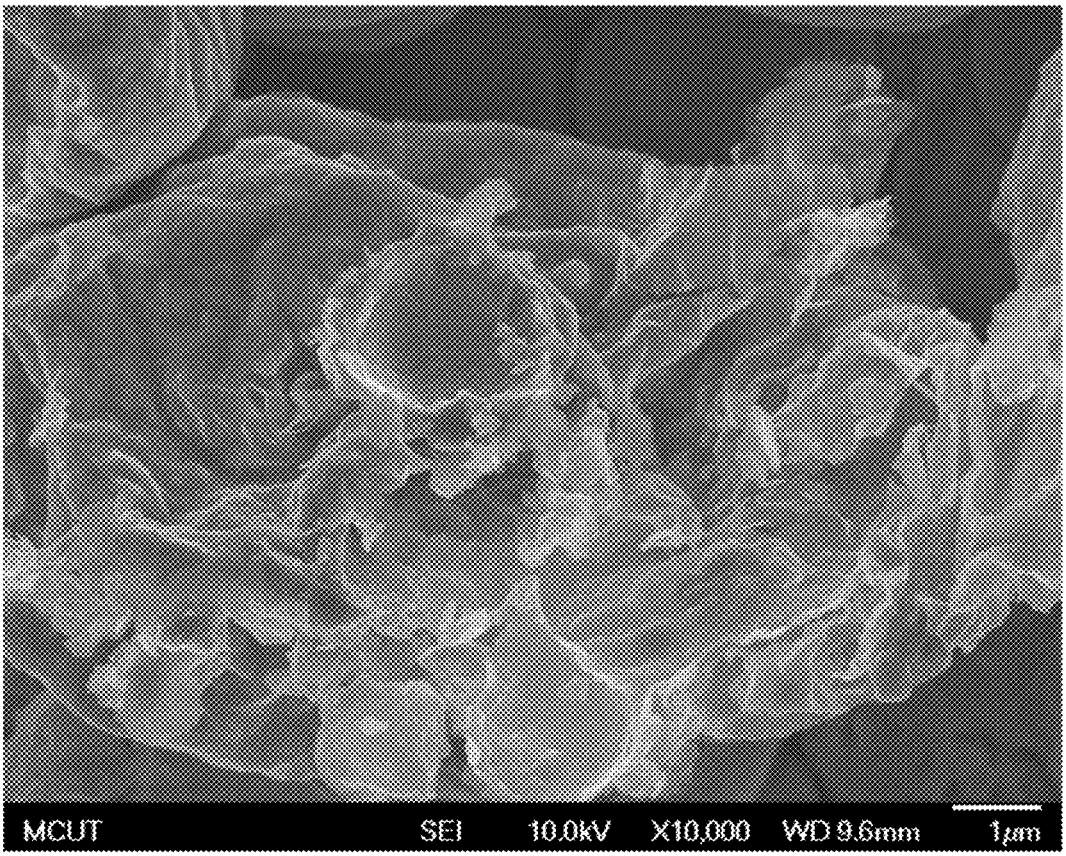
Figure 12:
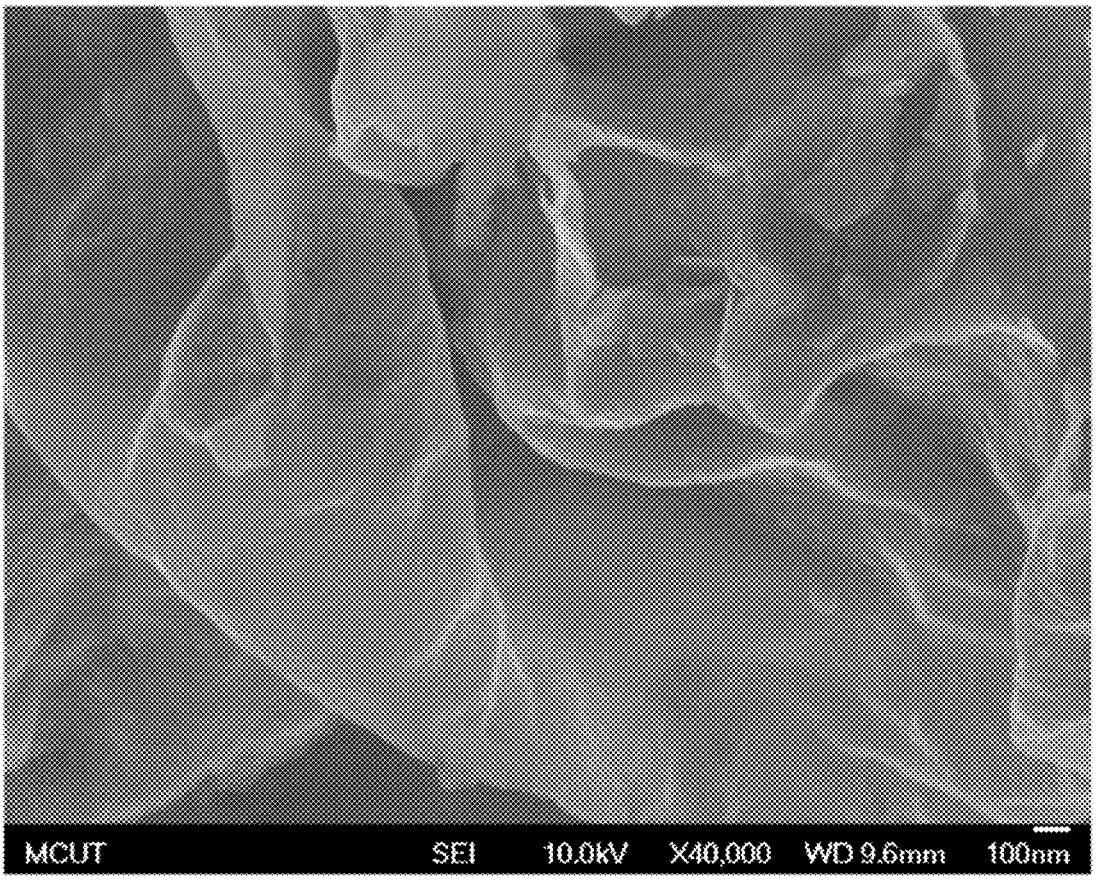
Figure 13:
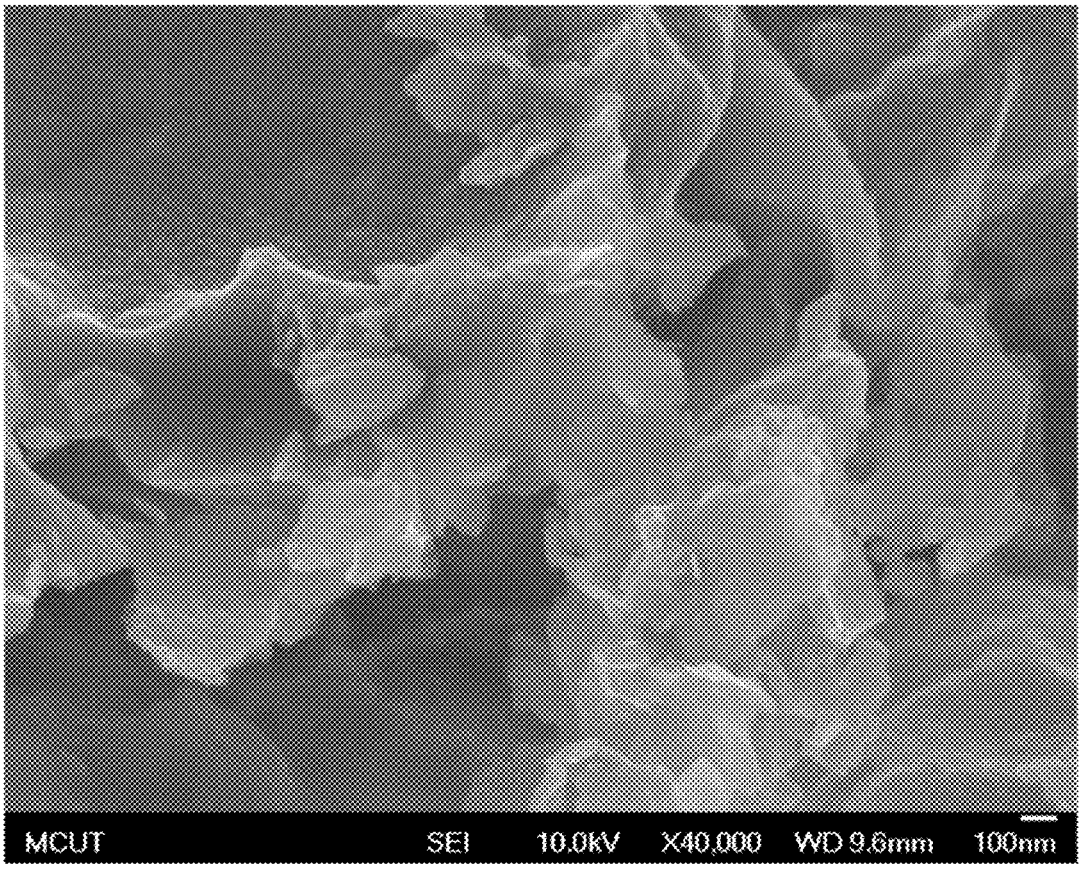

FIG. 8 is the X-ray diffraction spectrum of the ITO according to the first embodiment of the present disclosure The diffraction peaks corresponding to the ITO are clearly identified in the figure. The appearance of (222), (123), and (440) crystalline planes clearly demonstrates the existence of crystalline ITO. In other words, the presence of indium tin oxide coating may be confirmed from the elemental analysis diagram and X-ray diffraction chart.

FIG. 9 to FIG. 13 respectively are the surface morphologies of the ITO according to the second embodiment of the present disclosure. More specifically, these figures are at different magnifications, respectively: 1 k× for FIG. 9, 10 k× for FIG. 10 and FIG. 11, and 40 k× for FIG. 12 and FIG. 13. As shown in the figure, the surface morphology of the indium tin oxide of the second embodiment is also round particles, which is similar to the first embodiment. In addition, the sizes of the grains are within about 10 um-20 um.

Figure 14:
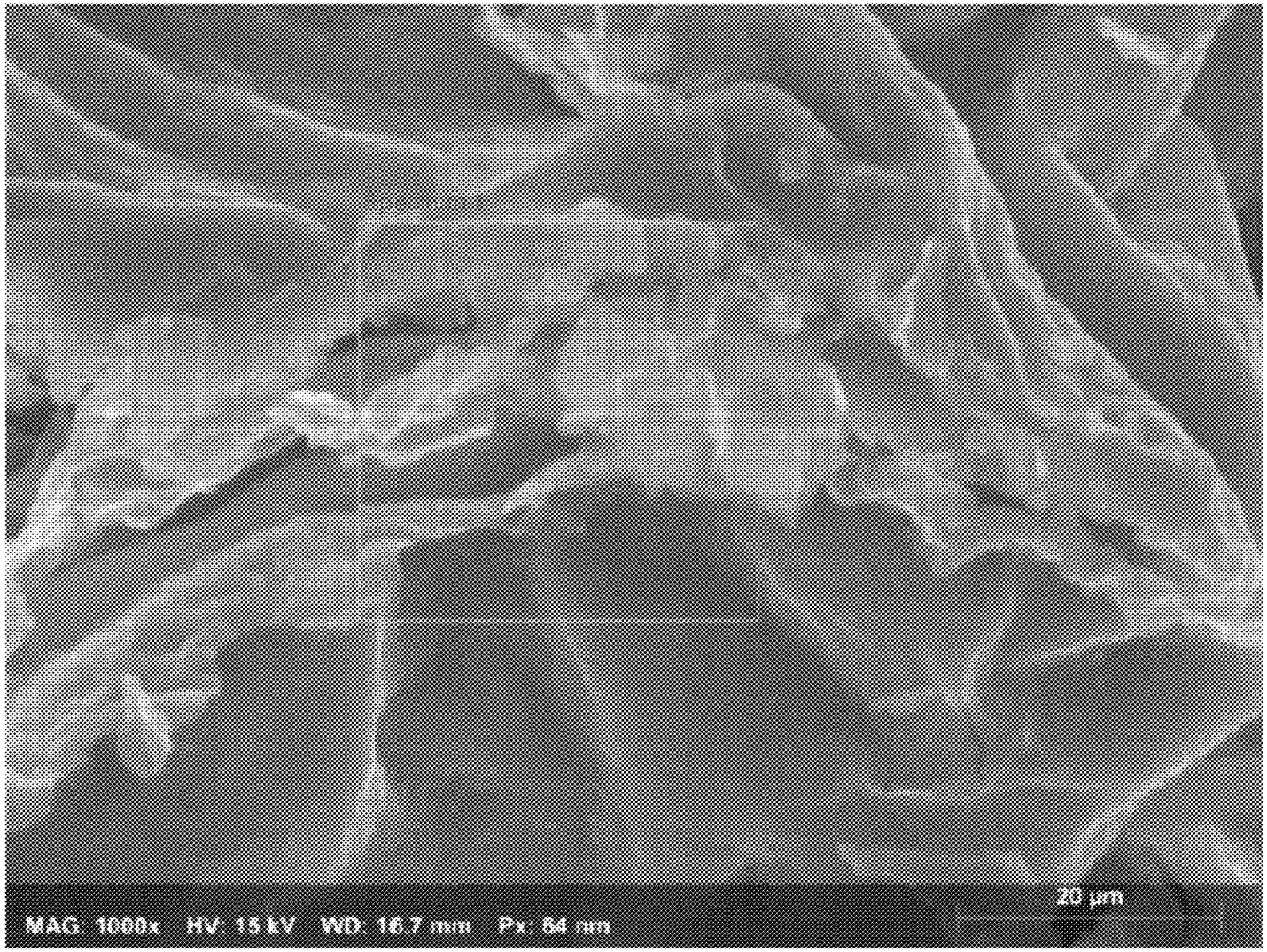
Figure 15:
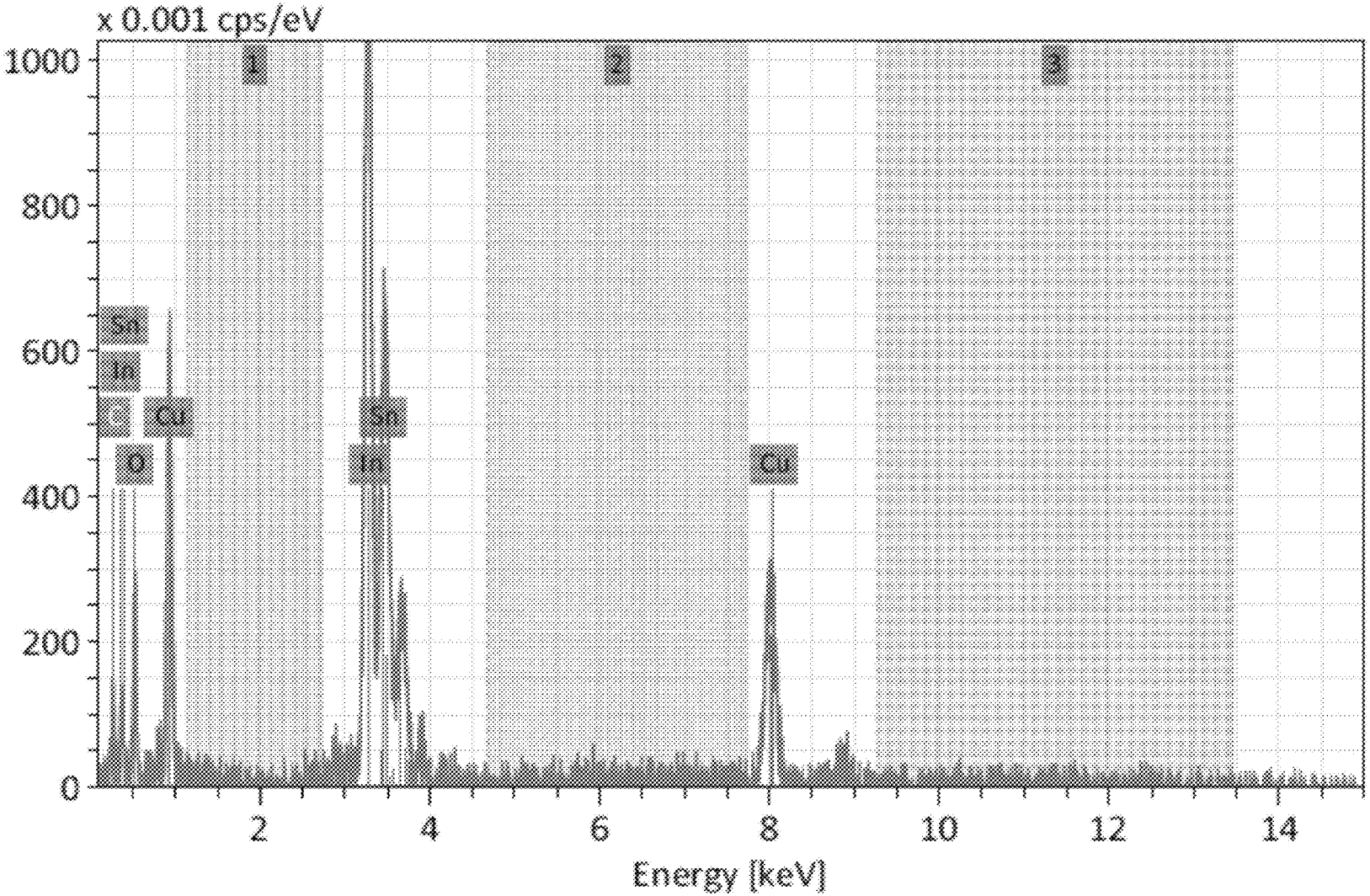
FIG. 15 is the element analysis diagram of the ITO according to the second embodiment of the present disclosure.

FIG. 14 and FIG. 15 respectively are the surface morphology and element analysis diagram of the indium tin oxide coating manufacturing according to the second embodiment of the present disclosure. Specifically, FIG. 15 presents the measured compositions from a certain region in FIG. 14. Further, the composition of the components in FIG. 15 is converted into weight percentage and atomic percentage as shown in Table 3. As shown in the figure, that the coating includes indium and tin may be confirmed from the composition weight percent (wt. %) or atom percentage (at. %).

TABLE 3

| Element | Atomic number | Spectrum | Compositions wt. % | Compositions at. % |
|---|---|---|---|---|
| Oxygen | 8 | K series | 6.78 | 26.19 |
| Copper | 29 | K series | 30.21 | 29.36 |
| Indium | 49 | L series | 29.22 | 15.72 |
| Tin | 50 | L series | 31.37 | 16.33 |
| Carbon | 6 | K series | 2.41 | 12.40 |

Figure 16:
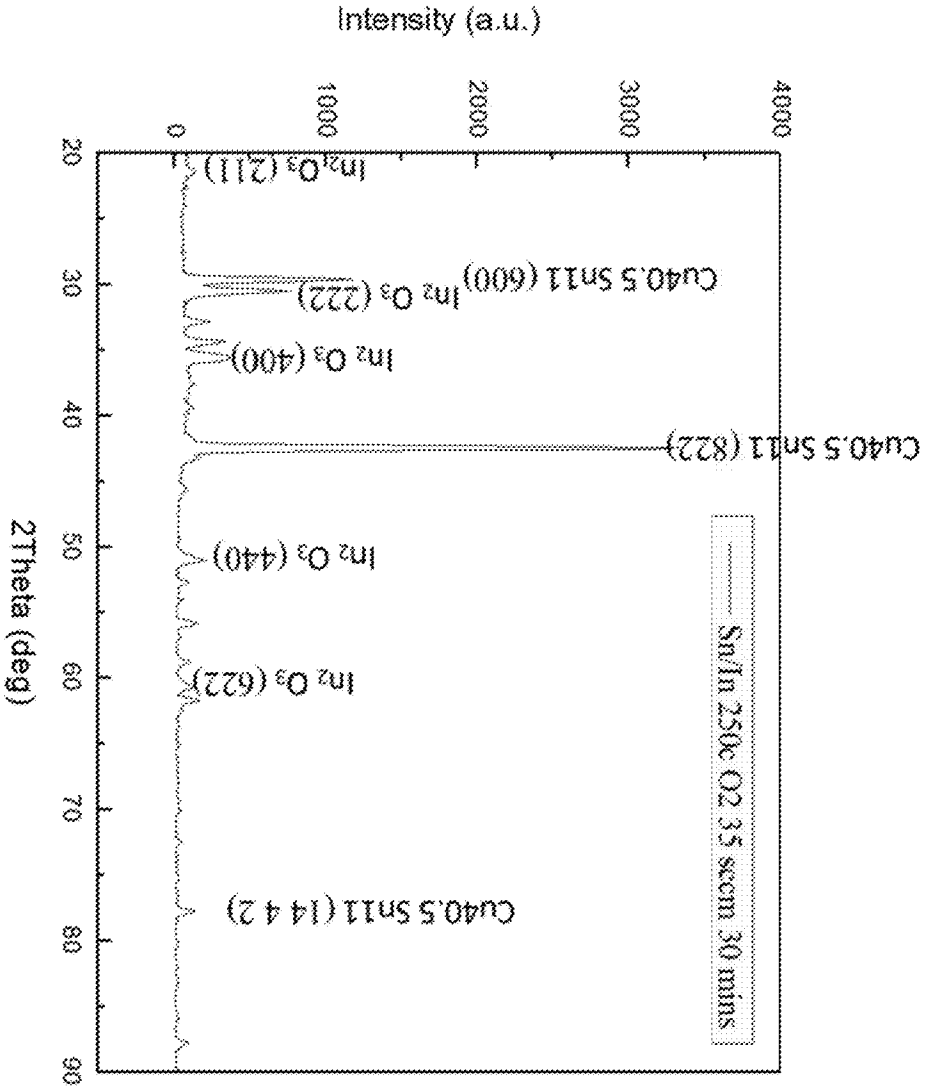
FIG. 16 is the X-ray diffraction spectrum of the ITO according to the second embodiment of the present disclosure.
Figure 17:
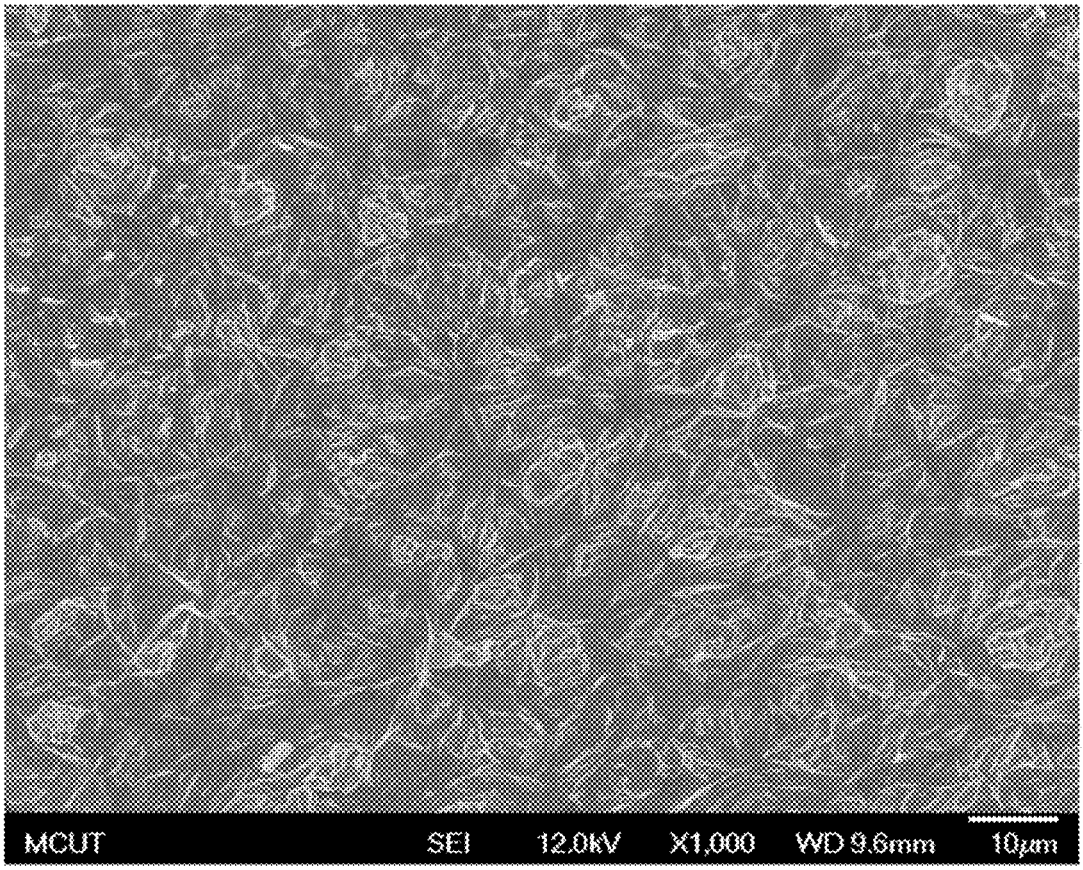
FIG. 17 to FIG. 22 respectively are the surface morphologies of the ITO according to the third embodiment of the present disclosure.
Figure 18:
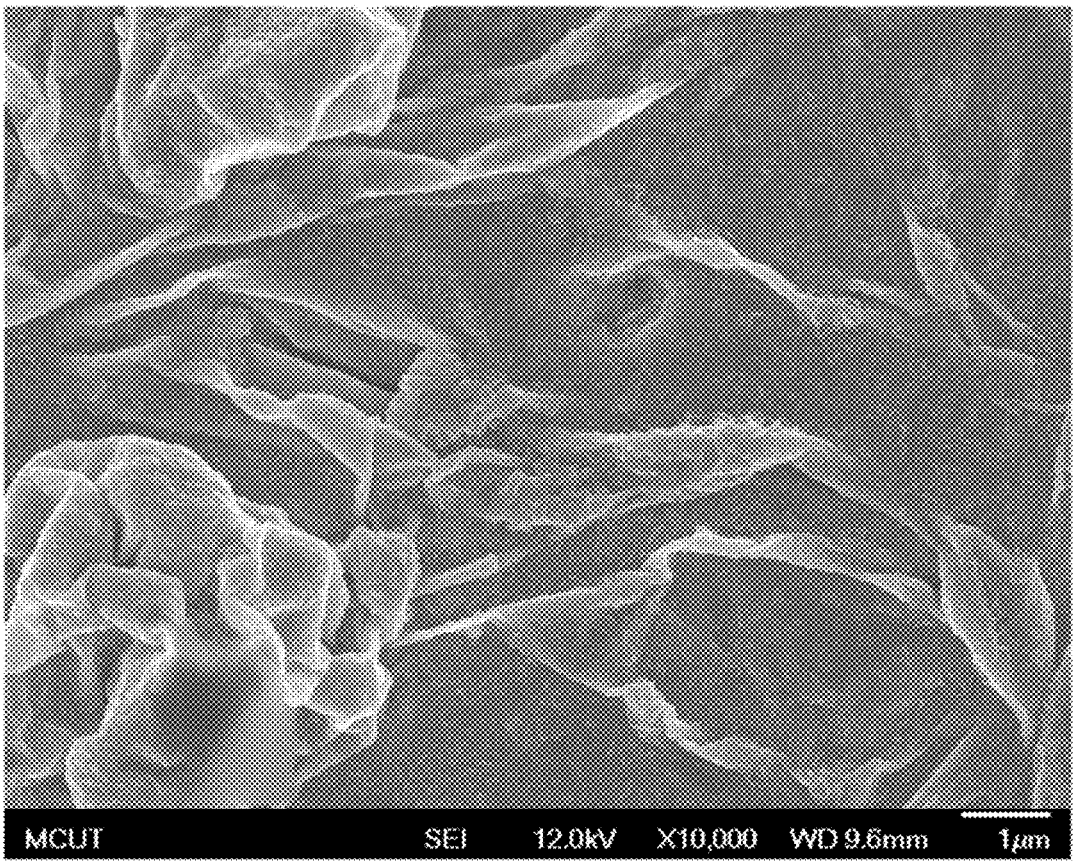
Figure 19:
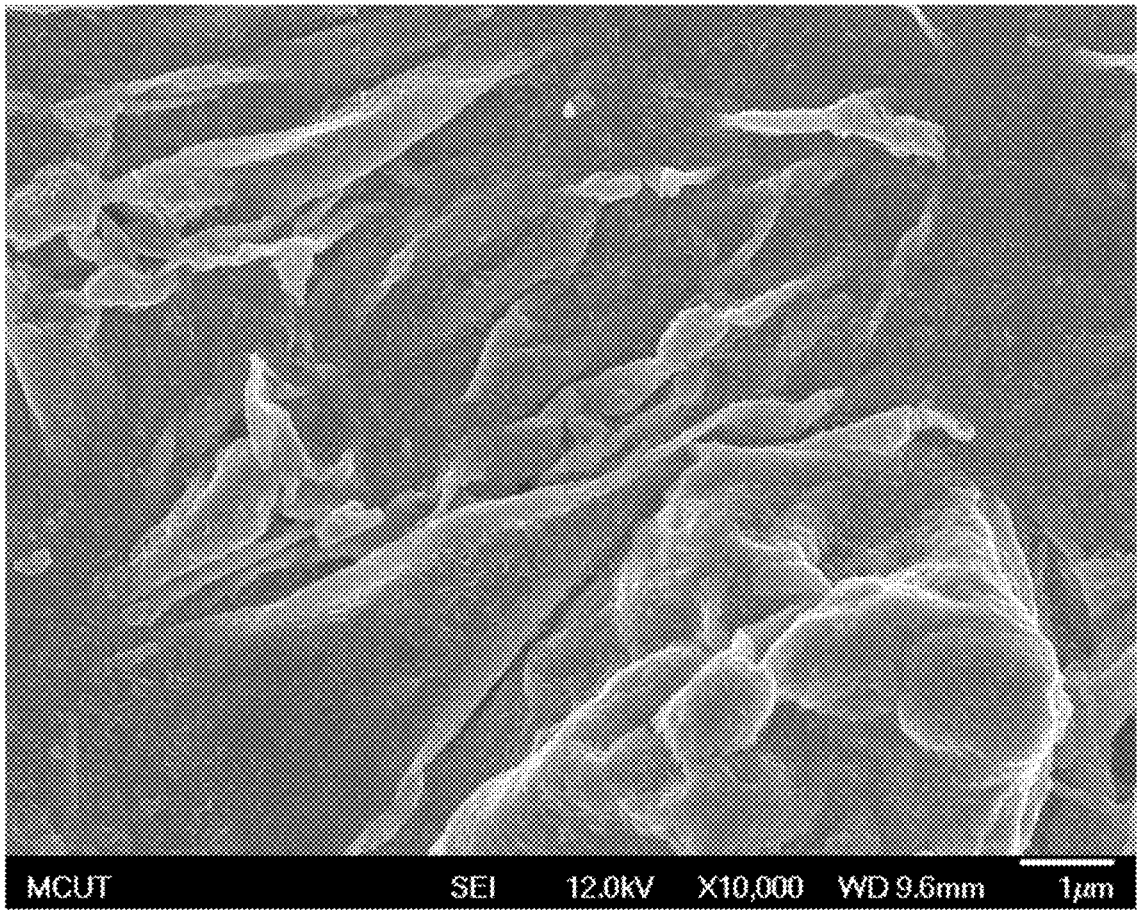
Figure 20:
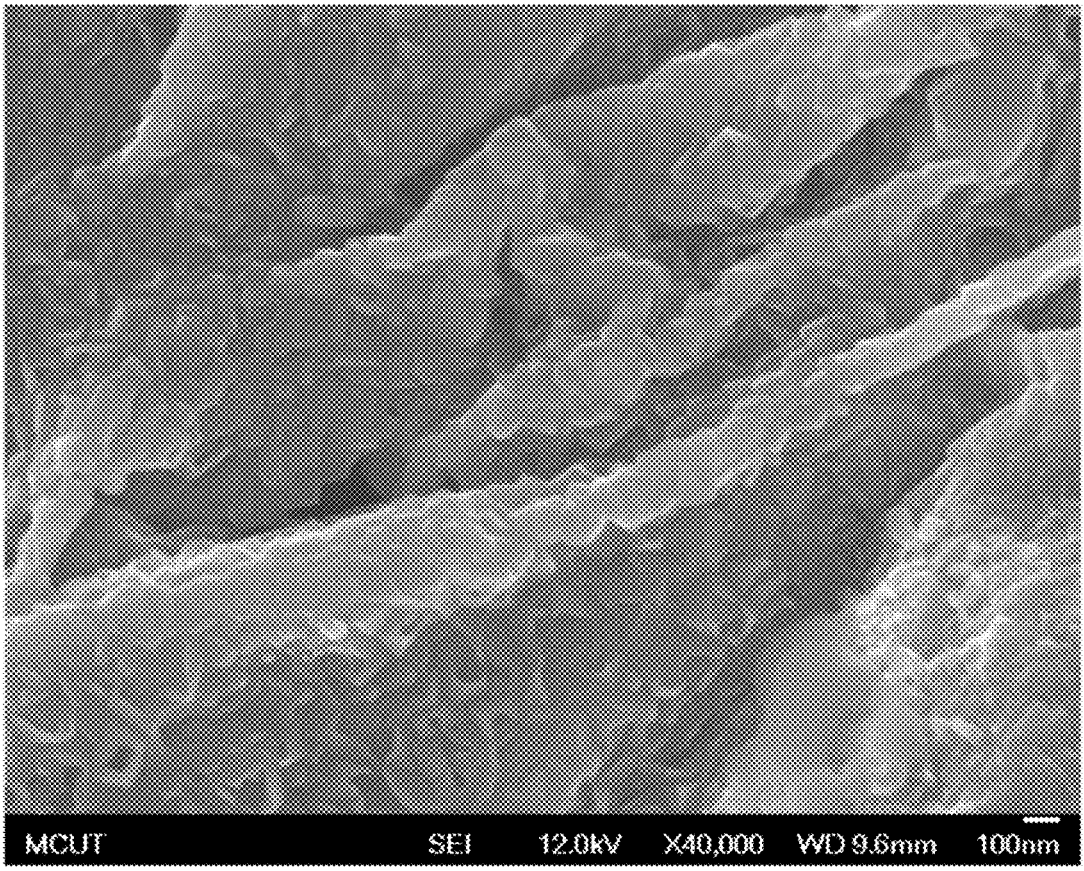
Figure 21:
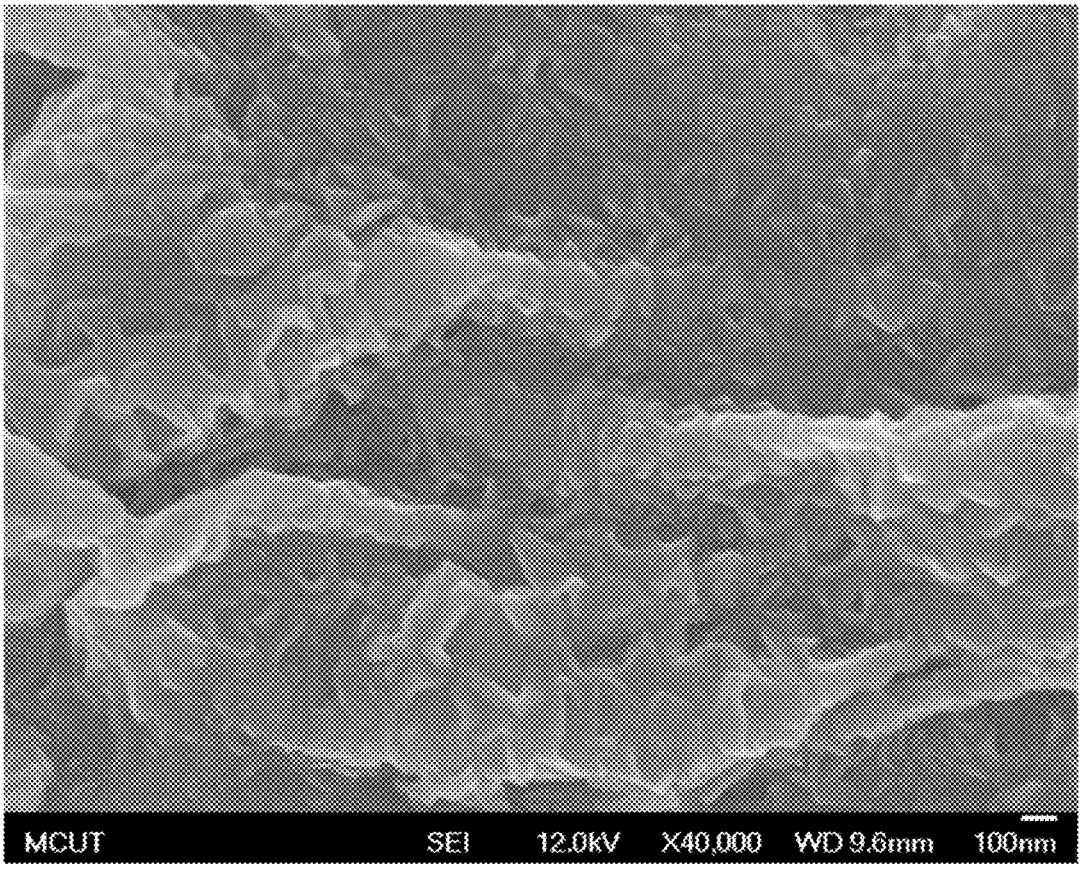

FIG. 16 is the X-ray diffraction spectrum of the ITO according to the second embodiment of the present disclosure The diffraction peaks corresponding to the ITO are clearly identified in the figure. The appearance of (211), (222), (400), (440), and (622) crystalline planes clearly demonstrates the existence of crystalline ITO. In other words, the presence of indium tin oxide coating may be confirmed from the elemental analysis diagram and X-ray diffraction chart.

FIG. 17 to FIG. 21 respectively are the surface morphologies of the ITO according to the third embodiment of the present disclosure. More specifically, these figures are at different magnifications, respectively: 1 k× for FIG. 17, 10 k× for FIG. 18 and FIG. 19, and 40 k× for FIG. 20 and FIG. 21. As shown in the figure, the surface morphology of the indium tin oxide of the third embodiment is a plate structure, which is different from the particles of the first embodiment and the second embodiment.

Figure 22:
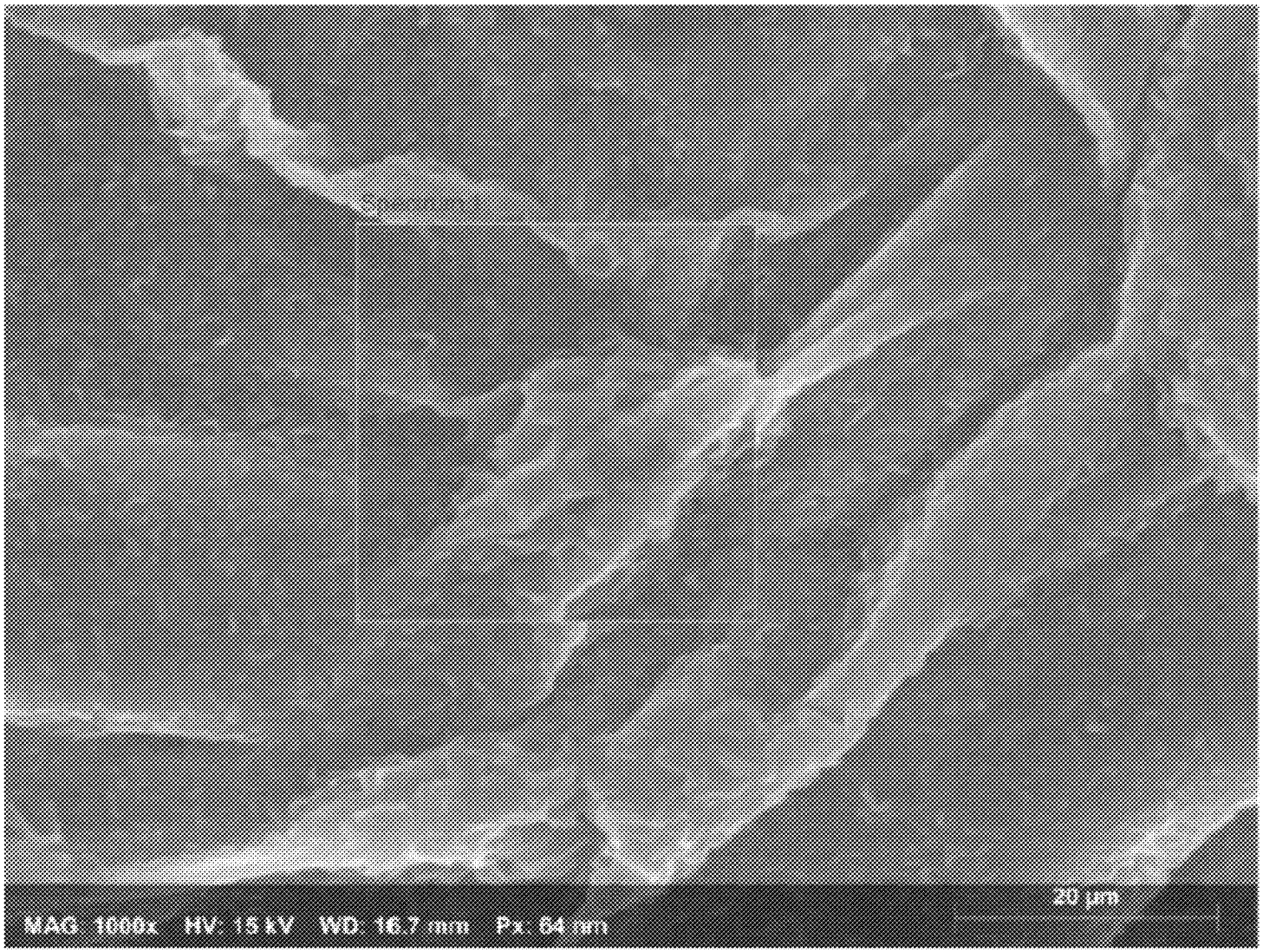
Figure 23:
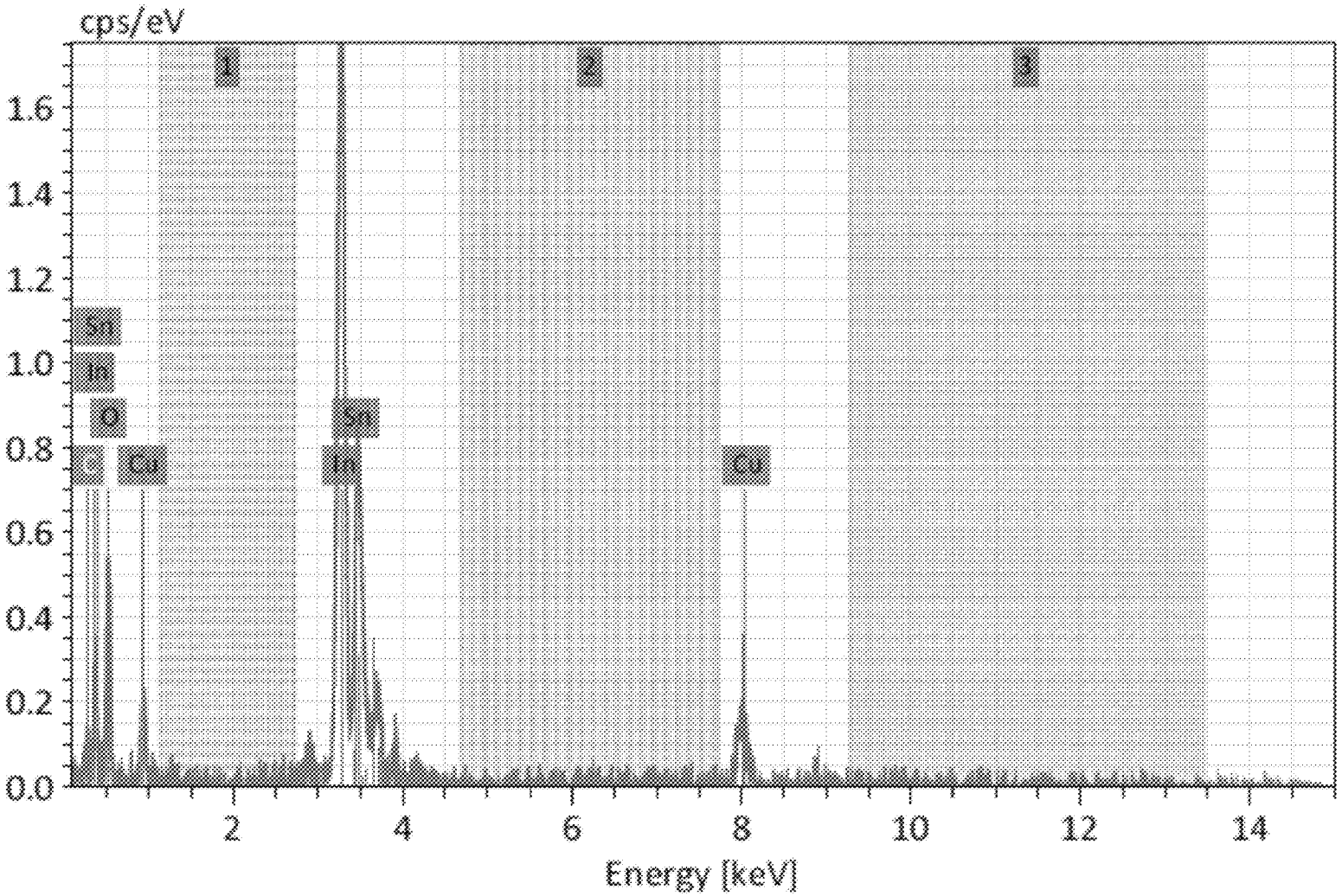
FIG. 23 is the element analysis diagram of the ITO according to the third embodiment of the present disclosure.

FIG. 22 and FIG. 23 respectively are the surface morphology and element analysis diagram of the indium tin oxide coating manufacturing according to the second embodiment of the present disclosure. Specifically, FIG. 23 presents the measured compositions from a certain region in FIG. 22. Further, the composition of the components in FIG. 23 is converted into weight percentage and atomic percentage as shown in Table 4. As shown in the figure, that the coating includes indium and tin may be confirmed from the composition weight percent (wt. %) or atom percentage (at. %).

TABLE 4

| Element | Atomic number | Spectrum | Compositions wt. % | Compositions at. % |
|---|---|---|---|---|
| Carbon | 6 | K series | 1.38 | 5.89 |
| Oxygen | 8 | K series | 15.97 | 51.12 |
| Copper | 29 | K series | 18.12 | 14.61 |
| Indium | 49 | L series | 36.85 | 16.44 |
| Tin | 50 | L series | 27.68 | 11.95 |

Figure 24:
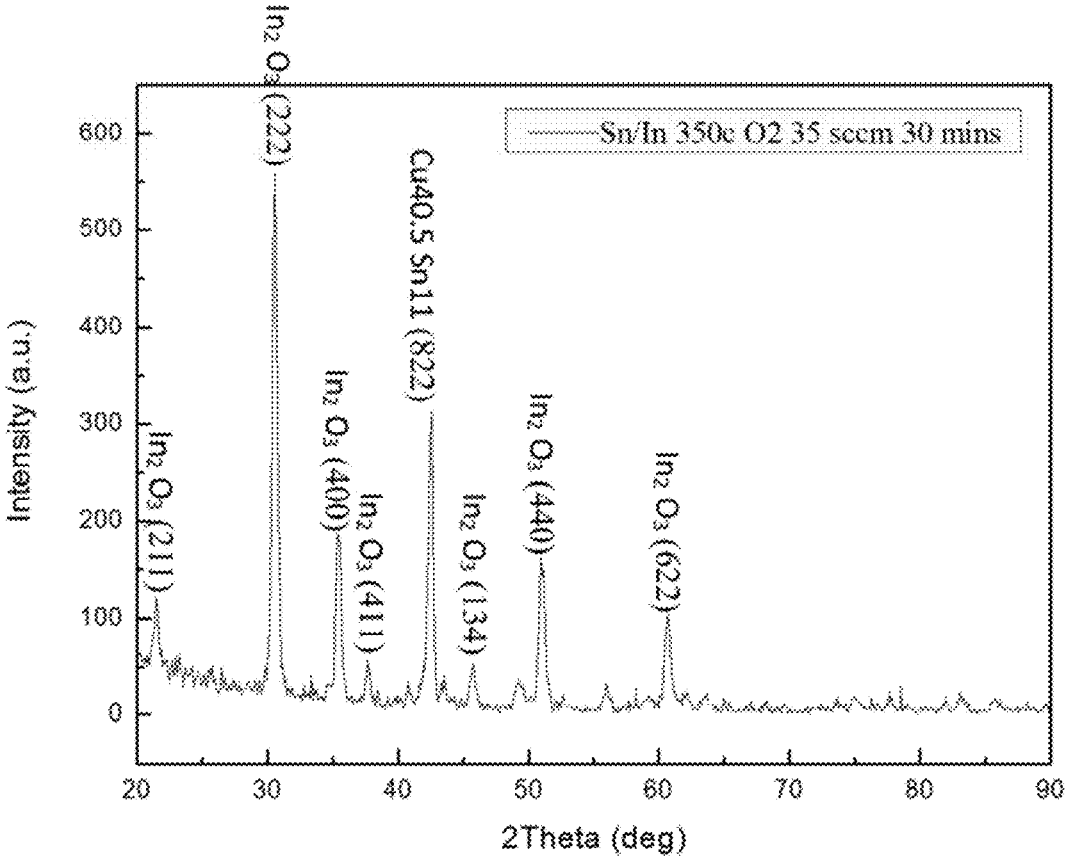
FIG. 24 is the X-ray diffraction spectrum of the ITO according to the third embodiment of the present disclosure.

FIG. 24 is the X-ray diffraction spectrum of the ITO according to the second embodiment of the present disclosure The diffraction peaks corresponding to the ITO are clearly identified in the figure. The appearance of (211), (222), (400), (411), (134), (440), and (622) crystalline planes clearly demonstrates the existence of crystalline ITO. In other words, the presence of indium tin oxide coating may be confirmed from the elemental analysis diagram and X-ray diffraction chart.

In summary, in the embodiment of the present disclosure, the indium is electroplated on the workpiece by the first electrolyte with specific compositions, and the tin is electroplated on the workpiece by the second electrolyte with specific compositions. Finally, the workpiece electroplated with indium and tin is annealed in an oxygen environment to obtain an indium tin oxide coating. The process of the present disclosure is simple and may be applied to large-area production. Moreover, the composition of the first electrolyte and the second electrolyte used in the electroplating process is safe and non-toxic, and the electrolyte may be reused to reduce the waste of resources.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the invention. Accordingly, such modifications are considered within the scope of the invention as limited solely by the appended claims.

A person of ordinary skill in the art will understand current and future manufacturing processes, method and step from the content disclosed in some embodiments of the present disclosure, as long as the current or future manufacturing processes, method, and step performs substantially the same functions or obtain substantially the same results as the present disclosure. Therefore, the scope of the present disclosure includes the above-mentioned manufacturing process, method, and steps.

The above descriptions are only examples of this application and are not intended to limit this application. This disclosure may have various modifications and changes for a person of ordinary skill in the art. Any modification, equivalent replacement, improvement, etc. made within the spirit and principle of this application shall be included in the scope of the claims of this disclosure.

What is claimed is:

1. A manufacturing method of indium tin oxide, comprising:

providing a first electrolyte comprising choline chloride, urea, indium chloride, boric acid, and ascorbic acid;

disposing a workpiece, wherein at least a part of the workpiece is in contact with the first electrolyte;

heating the first electrolyte to within 60° C. to 95° C.;

applying a first operating current to electroplate indium onto the workpiece to form an indium-coated workpiece;

providing a second electrolyte comprising choline chloride, urea, tin chloride, boric acid, and ascorbic acid;

disposing the indium-coated workpiece, wherein at least a part of the indium-coated workpiece is in contact with the second electrolyte;

heating the second electrolyte to within 60° C. to 95° C.;

applying a second operating current to electroplate tin onto the indium-coated workpiece to form a tin-indium-coated workpiece; and annealing the indium and tin on the tin-indium-coated workpiece to form indium tin oxide in an oxygen environment.

2. The manufacturing method of indium tin oxide of claim 1, wherein in the step of annealing the tin-indium-coated workpiece, 1 sccm to 40 sccm of oxygen gas is introduced to anneal the tin-indium-coated workpiece in the oxygen environment.

3. The manufacturing method of indium tin oxide of claim 1, wherein the annealing temperature is from 150° C. to 400° C.

4. The manufacturing method of indium tin oxide of claim 1, wherein the first operating current is from 1 mA to 10 mA, and the second operating current is from 1 mA to 10 mA.

5. The manufacturing method of indium tin oxide of claim 1, wherein molar ratios of choline chloride to urea in the first electrolyte and the second electrolyte are both 1:2.

6. The manufacturing method of indium tin oxide of claim 1, wherein a molar concentration of indium chloride in the first electrolyte is from 0.005 M to 1 M.

7. The manufacturing method of indium tin oxide of claim 1, wherein a molar concentration of tin chloride in the second electrolyte is from 0.005 M to 1 M.

8. The manufacturing method of indium tin oxide of claim 1, wherein molar concentrations of boric acid in the first electrolyte and the second electrolyte are both from 0.7 M to 2 M.

9. The manufacturing method of indium tin oxide of claim 1, wherein molar concentrations of ascorbic acid in the first electrolyte and the second electrolyte are both from 0.025 M to 0.15 M.

10. The manufacturing method of indium tin oxide of claim 1, wherein the first electrolyte and the second electrolyte further comprise saccharin, and molar concentrations of saccharin in the first electrolyte and the second electrolyte are both from 0.03 M to 0.2 M.

* * * * *